US009585201B1

(12) United States Patent
Lovens et al.

(10) Patent No.: US 9,585,201 B1
(45) Date of Patent: Feb. 28, 2017

(54) ELECTRIC INDUCTION HEATING OF RAILS

(71) Applicant: Inductotherm Corp., Rancocas, NJ (US)

(72) Inventors: Jean Lovens, Embourg (BE); Michel Fontaine, Aywaille (BE); Philippe Weber, Liége (BE)

(73) Assignee: INDUCTOTHERM CORP., Rancocas, NJ (US)

( * ) Notice: Subject to any disclaimer, the term of this patent is extended or adjusted under 35 U.S.C. 154(b) by 142 days.

(21) Appl. No.: 14/321,019

(22) Filed: Jul. 1, 2014

Related U.S. Application Data

(60) Provisional application No. 61/842,116, filed on Jul. 2, 2013.

(51) Int. Cl.
*H05B 6/10* (2006.01)
*C21D 1/42* (2006.01)
*H05B 6/44* (2006.01)

(52) U.S. Cl.
CPC ..... *H05B 6/101* (2013.01); *H05B 6/44* (2013.01)

(58) Field of Classification Search
CPC .... E01B 7/24; C21D 9/04; C21D 9/50; C21D 1/62; C21D 1/42; C21D 2211/009; Y02P 10/253; B23K 31/00; B23K 9/0026; B23K 23/00; B23K 31/022; B23K 2201/26
USPC ..... 219/637, 635, 639, 604, 658, 652, 654, 219/657, 671; 148/526, 529, 569, 585, 148/510, 566, 567
See application file for complete search history.

(56) References Cited

U.S. PATENT DOCUMENTS

| | | | | |
|---|---|---|---|---|
| 2,170,965 | A | 7/1937 | Drake | |
| 3,276,924 | A * | 10/1966 | Okamoto | C21D 9/06 148/569 |
| 3,336,459 | A | 8/1967 | Seulen et al. | |
| 3,446,930 | A | 5/1969 | Seulen et al. | |
| 3,489,875 | A | 1/1970 | Ross | |
| 3,684,851 | A | 8/1972 | Reinke et al. | |
| 3,705,285 | A | 12/1972 | Cachat | |
| 3,800,115 | A | 3/1974 | Cachat | |
| 3,836,743 | A | 9/1974 | Wardwell et al. | |
| 4,122,321 | A | 10/1978 | Cachat | |
| 4,300,031 | A | 11/1981 | Reboux et al. | |
| 4,388,593 | A | 6/1983 | Mittleman | |
| 4,749,419 | A | 6/1988 | Sommer et al. | |
| 5,004,510 | A | 4/1991 | Yu et al. | |
| 5,308,946 | A | 5/1994 | Mohr | |
| 5,473,960 | A | 12/1995 | Sakamoto et al. | |
| 5,550,353 | A | 8/1996 | Peysakhovich et al. | |

(Continued)

FOREIGN PATENT DOCUMENTS

| | | | |
|---|---|---|---|
| CN | 2147706 | Y | 11/1993 |
| GB | 933860 | A | 8/1963 |

(Continued)

*Primary Examiner* — Quang Van
(74) *Attorney, Agent, or Firm* — Philip O. Post

(57) ABSTRACT

An electric induction rail heater is provided for selectively adjusting the heated temperatures in a rail's head, web and foot sections after fabrication of the rail. Alternatively, the rail heater can be used for heating the opposing ends of two rails that are to be welded together. The electric induction rail heater is a transverse flux electric inductor that can be provided with or without magnetic cores.

17 Claims, 28 Drawing Sheets

(56) References Cited

U.S. PATENT DOCUMENTS

| | | | | |
|---|---|---|---|---|
| 5,922,234 | A | 7/1999 | Grow et al. | |
| 6,570,141 | B2 | 5/2003 | Ross | |
| 2005/0081479 | A1 | 4/2005 | Tjoelker et al. | |
| 2009/0065501 | A1 | 3/2009 | Dickson et al. | |
| 2013/0133784 | A1* | 5/2013 | Kristan | C21D 9/04 148/526 |

FOREIGN PATENT DOCUMENTS

| | | | | |
|---|---|---|---|---|
| JP | 57137425 | A | | 8/1982 |
| JP | 2002332602 | A | | 11/2002 |
| KR | 2001-0077051 | A | | 8/2001 |
| KR | 20080091533 | A | * | 10/2008 |
| WO | 8603646 | A | | 6/1986 |

* cited by examiner

ELECTRIC INDUCTION HEATING OF RAILS

CROSS-REFERENCE TO RELATED APPLICATIONS

This application claims the benefit of U.S. Provisional Application No. 61/842,116 filed Jul. 2, 2013, which is hereby incorporated by reference in its entirety.

FIELD OF THE INVENTION

The present invention relates to electric induction heating of rails to adjust the temperature distribution of the rails after rail fabrication for metallurgical heat treatment or to weld ends of rails together.

BACKGROUND OF THE INVENTION

Rails used in the construction of railroad track require heat treatment to withstand metallurgical failure in normal use. FIG. 1(*a*) and FIG. 1(*b*) illustrate a typical flat-bottom rail 90 comprising head 90*a*, web 90*b* and foot 90*c*. Heat treatment, or metallurgical hardening, is sometimes focused on the rail's head since the head is the region that makes contact with the wheels of rolling stock, while the web connects the head to the foot for distribution of the bearing load to sleepers, or ties, and the bed beneath the rails. FIG. 1(*c*) illustrates typical terminology that is used to describe approximate regions of the head. The crown, or running surface, is the region making contact with a wheel's rim, while the wheel's flanges generally make contact with one side surface of the head. Lower jaw regions define the region of the head that connects the head to web 90*b*. Modern railroad design, for example rails for high speed trains, can require relatively long lengths of a continuous rail, for example, in excess of 20 meters. Rails can be fabricated in a hot rolling mill that produces a hot length of rail by forging.

Heat treatment of the rail can be accomplished upon exit from the rolling mill, for example, by proper scaling of the rail and quenching with a fluid medium, such as air and/or water.

Satisfactory heat treatment of the rail's head must be performed when at least the cross sectional temperature profile of the head is generally the same along the entire longitudinal length, $L_r$, of the head. One approach is to heat the entire length of rail (that is, the head, web and foot) to the preferred cross sectional temperatures in the head, web and foot after hot rail fabrication to minimize deformation of the rail. Typically an axial (solenoidal) coil is used where the entire cross section of the rail passes through the axial coil to be inductively heated. FIG. 1(*d*) and FIG. 1(*e*) illustrate with diagrammatic arrows the direction of instantaneous current flow around a cross section of a rail passing through an axial coil. Axial induction heating coils are ideal when the workpiece passing through the axial coil has a generally shaped perimeter such as a metal strip or slab (rectangular shape) or tubular (circular shape) for excellent temperature uniformity. When the workpiece has a non-generally shaped (complex) perimeter such as the rail shown in FIG. 1(*b*) axial heating results in overheating of the foot (a shape with a high surface-to-volume ratio) and under heating of the head (a shape with a low surface-to-volume ratio compared to the foot). This differential temperature between the foot and head can create severe deformation of the rail due to the high heat expansion of the foot in comparison with the low heat expansion of the head. Consequently massive straightening rolls are required to keep the inductively heated rail from deforming as it passes through one or more axial induction coils.

Another approach is to preferably heat only the head of the rail to preferred cross sectional temperature after rail fabrication.

In either approach identified in the two previous paragraphs the different masses of the rail head, web and foot need to be considered relative to magnitude of applied induction power and "heat soaking" of the inducted heat into the rail head, web and foot.

One object of the present invention includes adjusting the temperature of the entire cross sectional temperature profile of a rail throughout the entire length of the rail with a transverse flux electric inductor rail heater.

Another object of the present invention includes adjusting the temperature of the cross section (transverse) profile of a rail's head throughout the entire length of the rail with an electric induction heater.

Another object of the present invention includes heating the entire cross sectional temperature profile of the opposing ends of two adjacent rail sections with a transverse flux electric inductor rail heater prior to welding together the two opposing ends of the rail sections.

Another object of the present invention is to induce more heating power into the head than in the foot of a rail with a transverse flux electric inductor to achieve the same temperature increase in the foot and head regions in order to avoid or minimize the deformation of the rail.

BRIEF SUMMARY OF THE INVENTION

Apparatus and method are provided for adjusting the rate of induced heating in a rail's head, web and foot. A transverse flux electric inductor rail heater is provided with a pair of coils disposed on opposing sides of the rail. Each coil comprises top (upper) and bottom (lower) longitudinal coil sections connected to opposing end riser sections on each side of the rail by transition coil sections in some examples of the invention. Sections of the coils may be moved adjustably during the induced heating process to adjust the ratio of rail head, web and foot heating. The transverse flux electric inductor rail heater can also be used to heat the opposing ends of two rails prior to welding the opposing ends of the two rails together.

In another aspect the present invention is a magnetic "C" core induction rail heater with a solenoidal coil wound around the longitudinal length of the magnetic "C" core and the rail's head, web and foot adjustably positioned within the opening of the magnetic "C" core.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification.

FIG. 1(*c*) identifies typical nomenclature for various regions of the head section of a typical railroad rail.

FIG. 1(*d*) and FIG. 1(*e*) illustrate with diagrammatic arrows the direction of instantaneous current flow around a cross section of a rail passing through a prior art axial coil.

DETAILED DESCRIPTION OF THE INVENTION

Figure 1D:
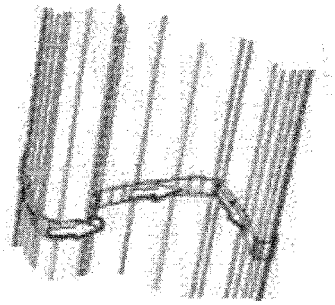
FIG. 1(*a*) and FIG. 1(*b*) illustrate one example of a typical railroad rail in perspective and cross section, respectively.
Figure 1E:
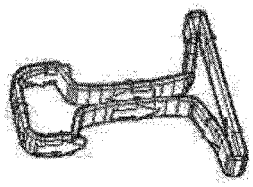
Figure 1B:
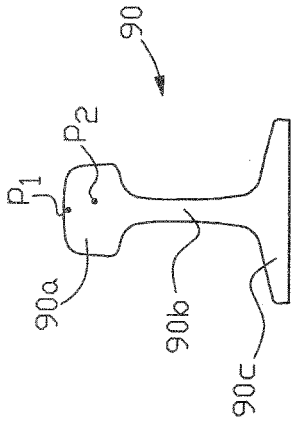
Figure 1A:
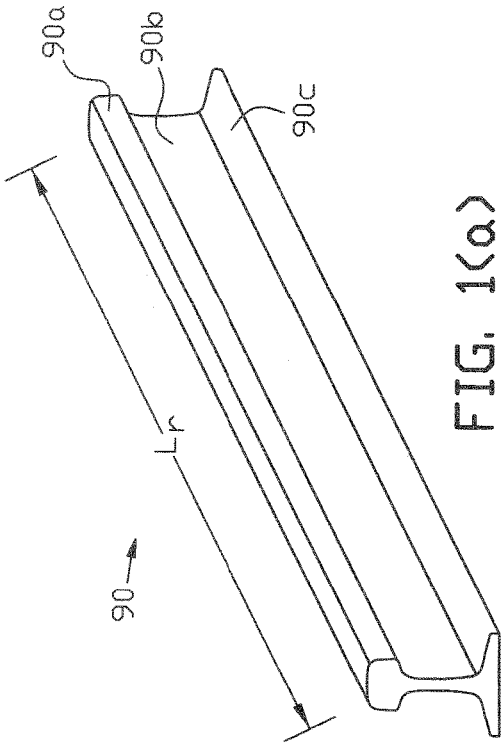
Figure 1C:
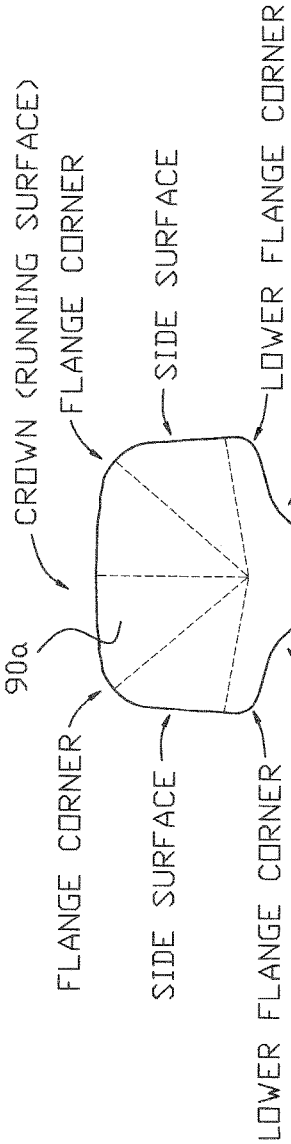
Figure 2:
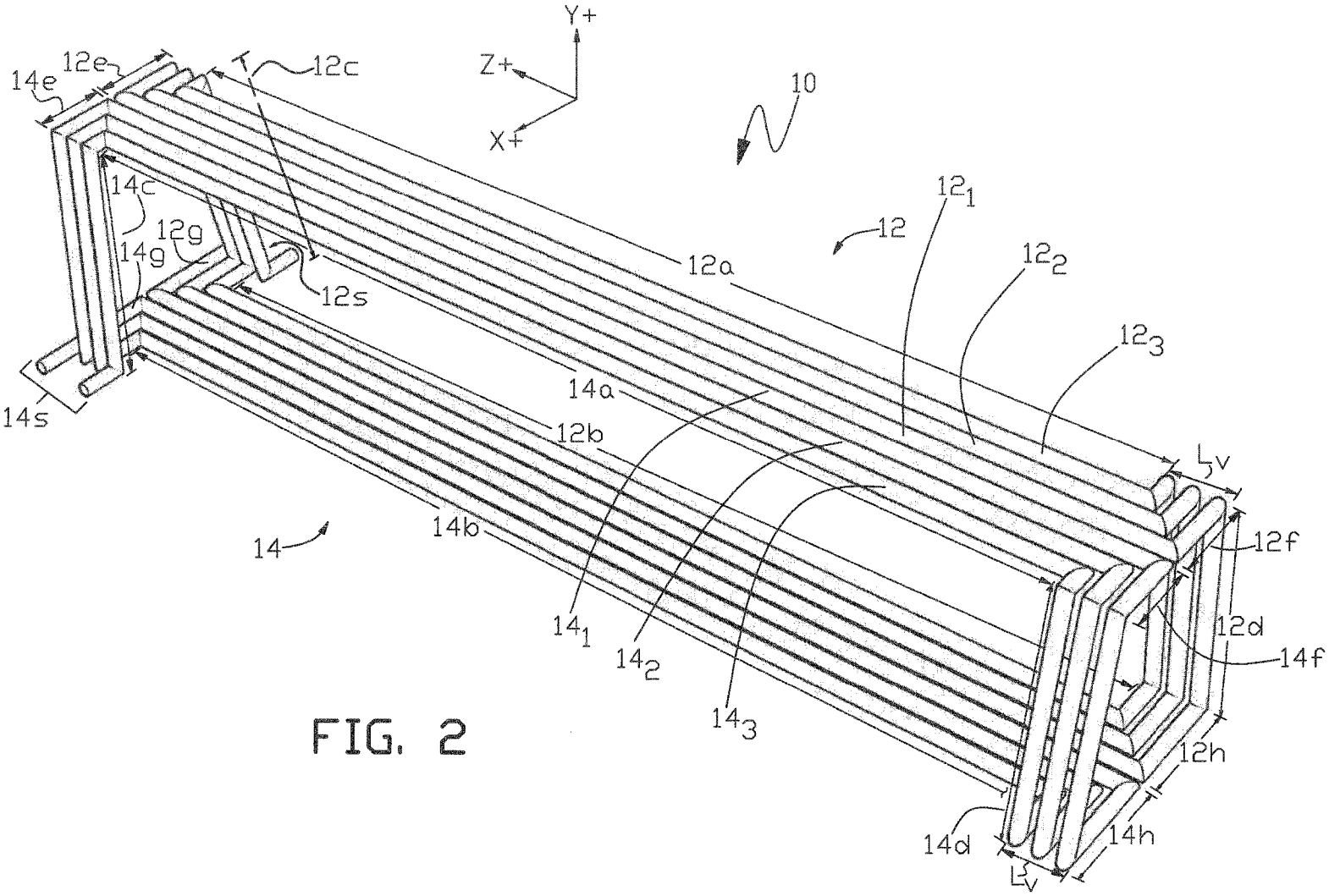
FIG. 2 is a perspective view of one example of an electric inductor rail heater of the present invention.
Figure 3:
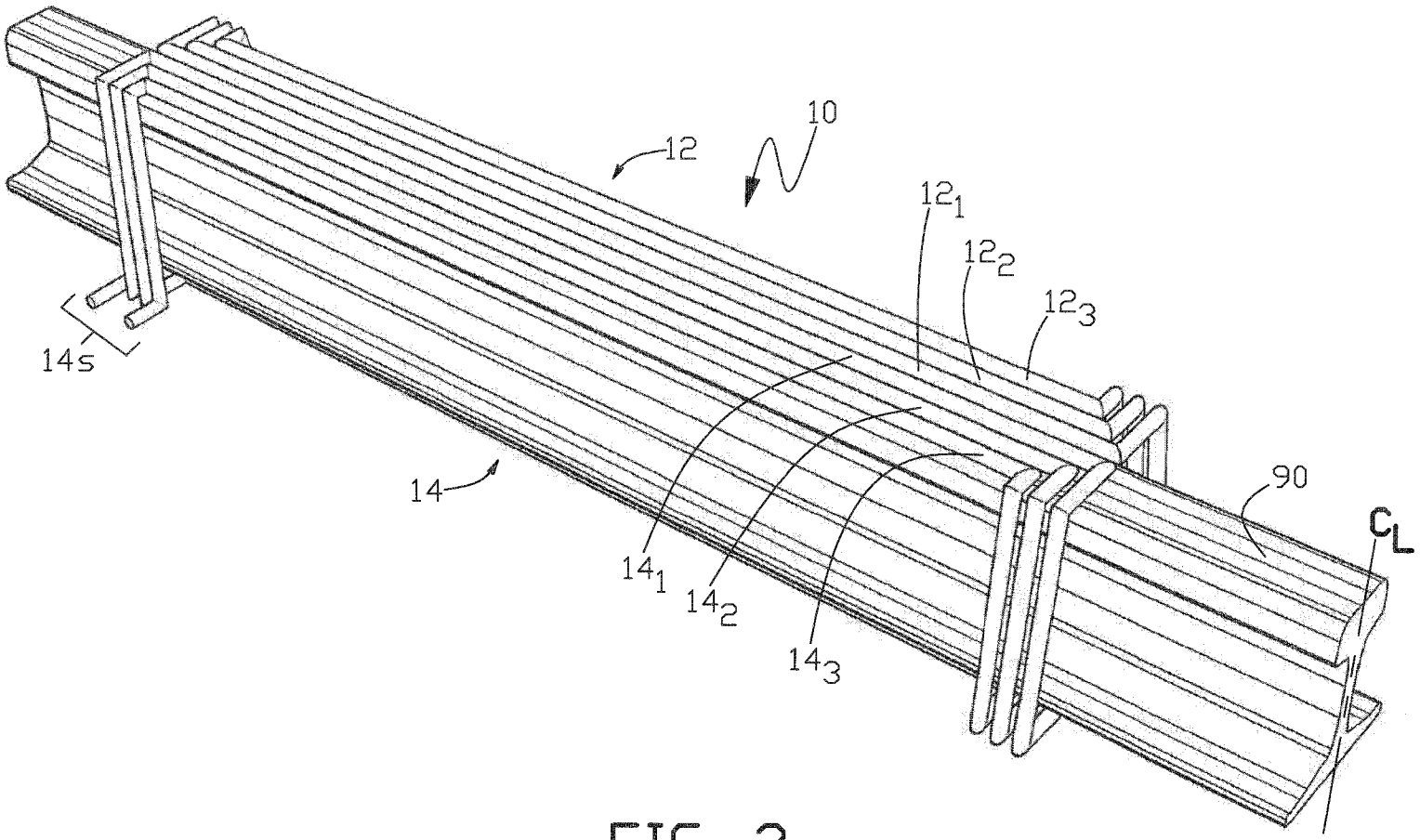
FIG. 3 illustrates a longitudinal section of rail within the electric inductor rail heater shown in FIG. 2.
Figure 4:
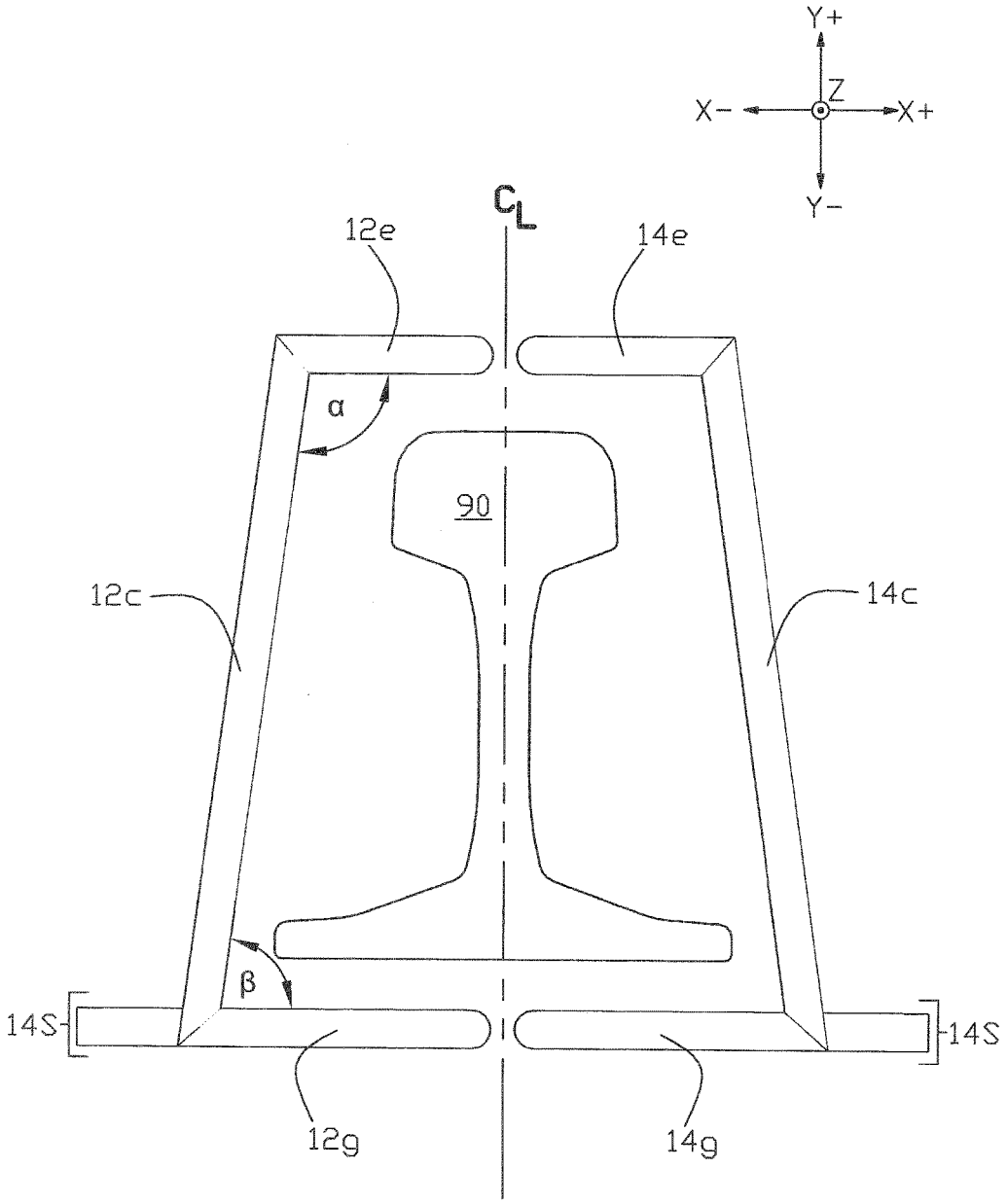
FIG. 4 is a front end elevation view of the rail within the electric inductor rail heater shown in FIG. 3.
Figure 23:
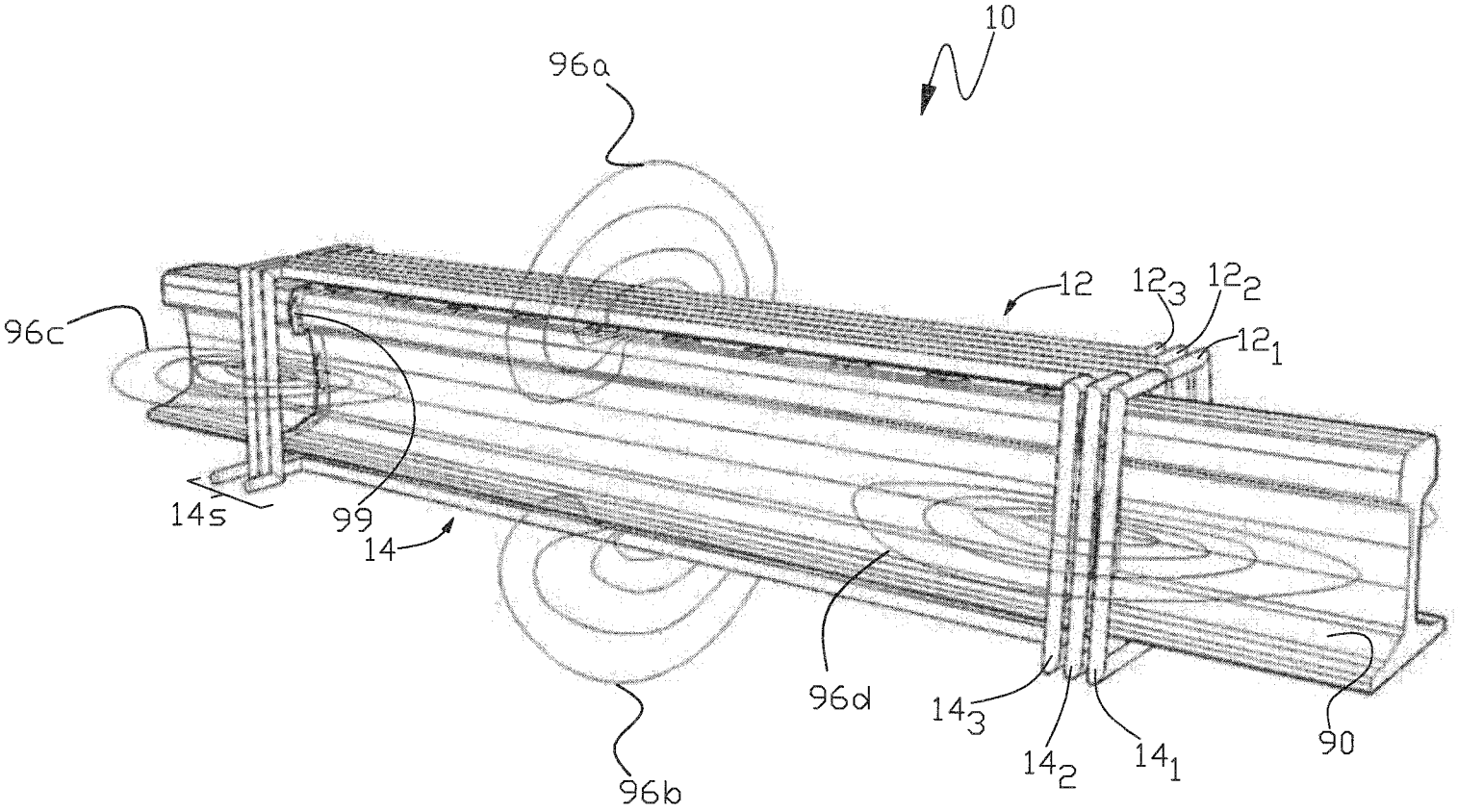
FIG. 23 illustrates with diagrammatic arrows the direction of induced instantaneous current flow in the rail for the arrangement shown in FIG. 3 when an alternating current is supplied to the electric inductor rail heater shown in FIG. 3.
Figure 24:
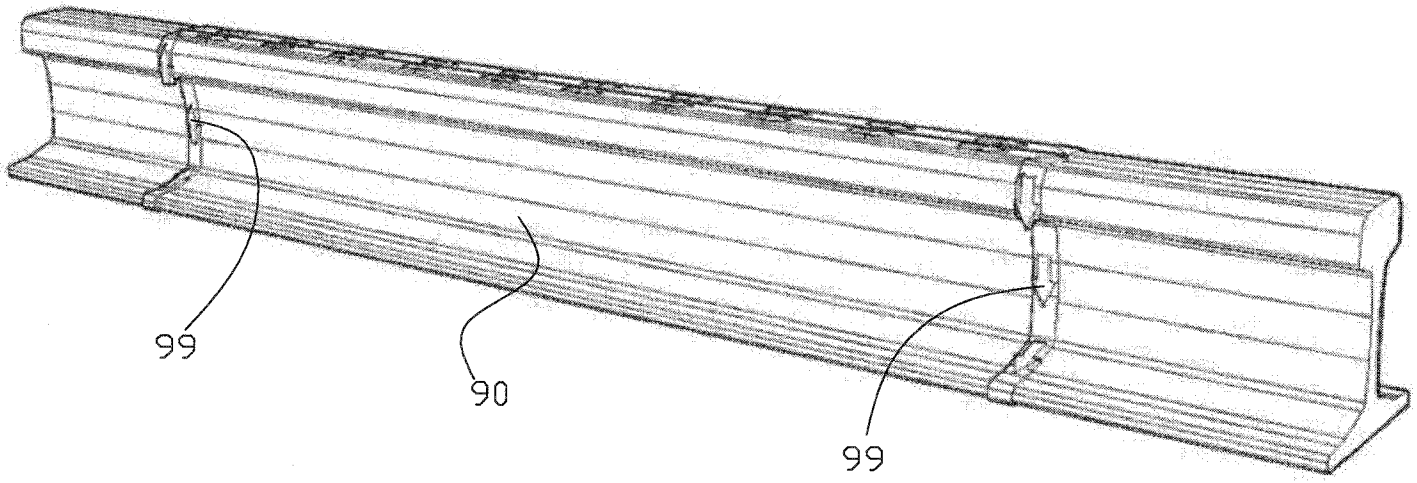
FIG. 24 illustrates with diagrammatic arrows the direction of induced instantaneous current flow in the rail in FIG. 23 with the electric inductor rail heater removed for clarity.
Figure 25:
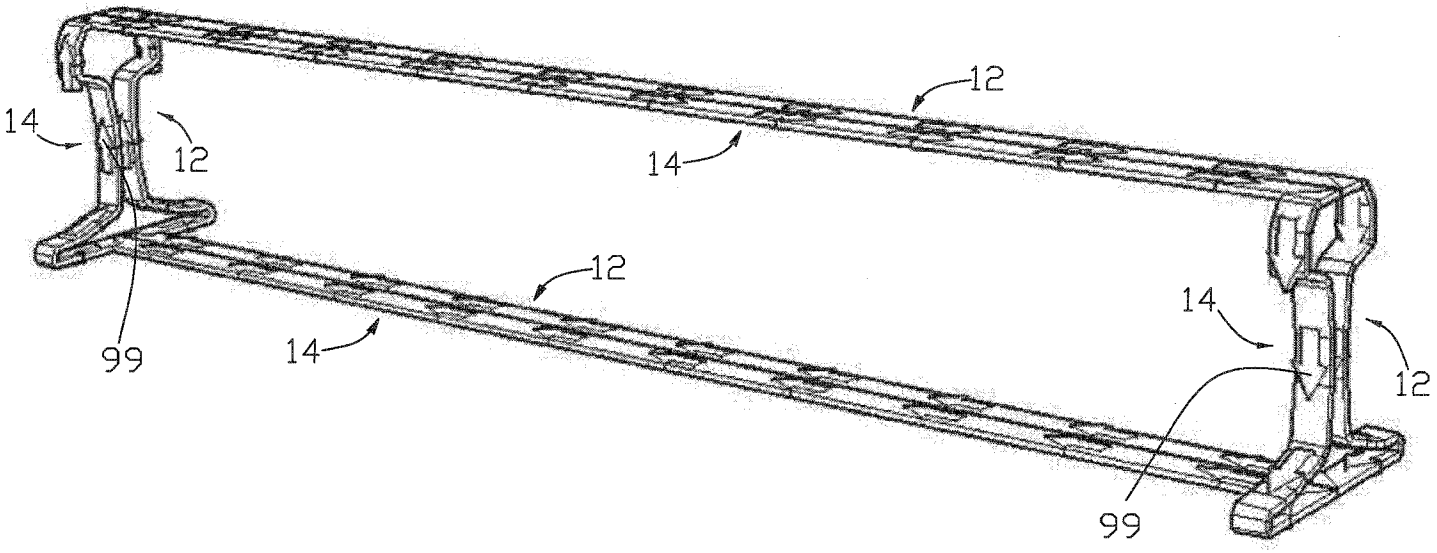
FIG. 25 illustrates with diagrammatic arrows the direction of induced instantaneous current flow paths in the rail in FIG. 22 with the electric inductor rail heater and rail removed for clarity.

There is shown in FIG. 2 through FIG. 13 one example of electric inductor rail heater 10 of the present invention. Heater 10 comprises a pair of high impedance coils 12 and 14 disposed on opposing sides of rail 90 to be inductively heated as shown in FIG. 2 (without a rail passing through the rail heater) and FIG. 3 (with a longitudinal rail section passing through the rail heater). In this example of the invention coils 12 and 14 are arranged in mirror image symmetry about the vertical center line $C_L$ of the rail being heat treated. For convenience of description and not limitation of orientation, the longitudinal rail side of the rail adjacent to coil 12 may be referred to as the first rail side and coil 12 may be referred to as the right rail side coil when viewing the rail and coil from the coil rear end riser coil sections (12*d* and 14*d*) to the front end riser coil sections (12*c* and 14*c*); and the longitudinal rail side of the rail adjacent to coil 14 may be referred to as the second rail side and coil 14 may be referred to as the left rail side coil when viewing the rail and coil from the coil rear end riser coil sections (12*d* and 14*d*) to the front end riser coil sections (12*c* and 14*c*). The pair of coils (12 and 14) forms a transverse flux electric inductor rail heater. In the illustrated example, each coil comprises upper and lower longitudinal coil sections 12*a*; 14*a* and 12*b*; 14*b* respectively, that are each parallel to the length $L_r$ (FIG. 1(*a*)) of rail 90 being heated, and front and rear coil riser coil sections 12*c*; 14*c* and 12*d*; 14*d* respectively, that are connected to the upper and lower longitudinal coil sections by upper and lower transition coil sections 12*e*, 14*e* 12*f*, 14*f* (upper transition sections) and 12*g*, 14*g* 12*h*, 14*h* (lower transition sections). Riser coil sections 12*c*, 14*c*, 12*d* and 14*d* are at an obtuse angle α to upper transition coil sections 12*e*, 14*e*, 12*f* and 14*f* and at an acute angle θ to the lower transition coil sections 12*g*, 14*g*, 12*h* and 14*f* as illustrated in FIG. 4. Thus the bottom transition coil sections are generally longer than the top transition coil sections when transition coil sections are used. The riser coil sections are generally perpendicular to the longitudinal coil sections, but may deviate from perpendicular to accommodate, for example, power terminal connections as shown for front riser sections 14*c* in FIG. 9. A suitable source of alternating current is supplied to both coils 12 and 14 at terminals 12*s* and 14*s* (FIG. 2) from one or more power supplies in this example of the invention. A single source may be used to supply alternating current to both coils 12 and 14 to ensure electrical phase synchronization and induced power magnitudes on opposing sides of the rail being heat treated. Transverse flux induced instantaneous current flow is in opposing directions in the head and foot of the rail as illustrated by diagrammatic current flow arrows 99 in FIG. 23 through FIG. 25.

Either rail 90 is conveyed by suitable means through the pair of coils 12 and 14 (as shown in FIG. 3) forming electric inductor rail heater 10 or the electric inductor rail heater travels along the length of the rail. Alternatively both the heater and rail may be moving simultaneously in opposing directions. More than one electric inductor rail heater may be disposed sequentially along the length of the rail to accomplish the required rate of induced heating as a function of the speed of the rail moving through the rail heater(s).

Mirror symmetry of the coil pair is used in the above examples of the invention. In other examples of the invention coils 12 and 14 may be identical to each other and arranged in opposite front and rear orientations on opposing sides of the rail with optional top or bottom center longitudinal power supply terminals to keep all alternating current power source terminations close to each other. If the rail's cross sectional profile is unsymmetrical, for example, if the rail is a shunting (switching) rail that takes advantage of the lack of rail symmetry to sort items of rolling stock into complete train sets in a shunting rail yard, the coil pair symmetry can be altered to suit the unsymmetrical rail cross sectional profile in other examples of the invention.

In this example of the invention coils 12 and 14 are each three turn ($\mathbf{12}_1$; $\mathbf{12}_2$; $\mathbf{12}_3$ and $\mathbf{14}_1$; $\mathbf{14}_2$; $\mathbf{14}_3$) coils as shown in the drawings while in other examples of the invention, coils with one or more turns can be used. Typically the number of turns is selected to facilitate impedance load matching with the output of the one or more power sources supplying alternating current to the coils. For a single turn transverse flux electric induction rail heater of the present invention the rail heater can comprise a right rail side single turn coil disposed adjacent to the first side of the rail, and a left rail side single turn coil disposed adjacent to the second side of the rail. The right rail side single turn coil has a right upper longitudinal single turn coil section disposed parallel to the longitudinal section of the rail and is located adjacently above the first side of the head of the rail. A right lower longitudinal single turn coil section is disposed parallel to the longitudinal section of the rail and located adjacently below the first side of the foot of the rail. A right front single turn riser coil section is disposed adjacently to the first side of the rail and generally oriented perpendicular to the longitudinal section of the rail. The right front single turn riser coil section connects the front adjacent ends of the right upper and lower longitudinal single turn coil sections when the transition coil sections in other examples of the invention form a part of the right upper and lower longitudinal coil sections. A right rear single turn riser coil section is disposed adjacently to the first side of the rail and generally oriented perpendicular to the longitudinal section of the rail. The right rear riser single turn coil section connects the rear adjacent ends of the right upper and lower longitudinal single turn coil sections when the transition coil sections in other examples of the invention form a part of the right upper and lower single turn longitudinal coil sections. The left rail side single turn coil has a left upper longitudinal single turn coil section disposed parallel to the longitudinal section of the rail and is located adjacently above the second side of the head of the rail. A left lower longitudinal single turn coil section is disposed parallel to the longitudinal section of the rail and located adjacently below the second side of the foot of the rail. A left front single turn riser coil section is disposed adjacently to the second side of the rail and generally oriented perpendicular to the longitudinal section of the rail. The left front single turn riser coil section connects the front adjacent ends of the left upper and left lower longitudinal single turn coil sections when the transition coil sections in other examples of the invention form a part of the right upper and lower longitudinal coil sections. A left rear single turn riser coil section is disposed adjacently to the second side of the rail and generally oriented perpendicular to the longitudinal section of the rail. The term "generally" is used to allow for arrangement of power termination connections that may alter the perpendicular orientation of a riser coil section to a longitudinal section of the rail. The left rear riser single turn coil section connects the rear adjacent ends of the right upper and right lower longitudinal single turn coil sections when the transition coil sections in other examples of the invention form a part of the right upper and right lower single turn longitudinal coil sections and separate transition sections are not used. In this single turn coil arrangement the right rail side coil forms a first one turn coil along the first side of the rail and the left rail side coil forms a second one turn coil along the second side of the rail. For multiple turn transverse flux electric induction rail heaters of the present invention, each coil section of the right rail side coil and left rail side coil can have an identical number of turns, and the right rail side coil and left rail side coil are arranged to provide a connection to at least one alternating current power source for each of the right rail side coil and the left rail side coil that can be located in any of the coil sections of the right and left rails side coil sections. The term "adjacently" is used above to describe the distance between a coil turn section and a section of the rail as required for a particular magnitude of induced heating to the section of the rail when a magnitude of alternating current is flowing through the coil turn section in a particular application.

Figure 8:
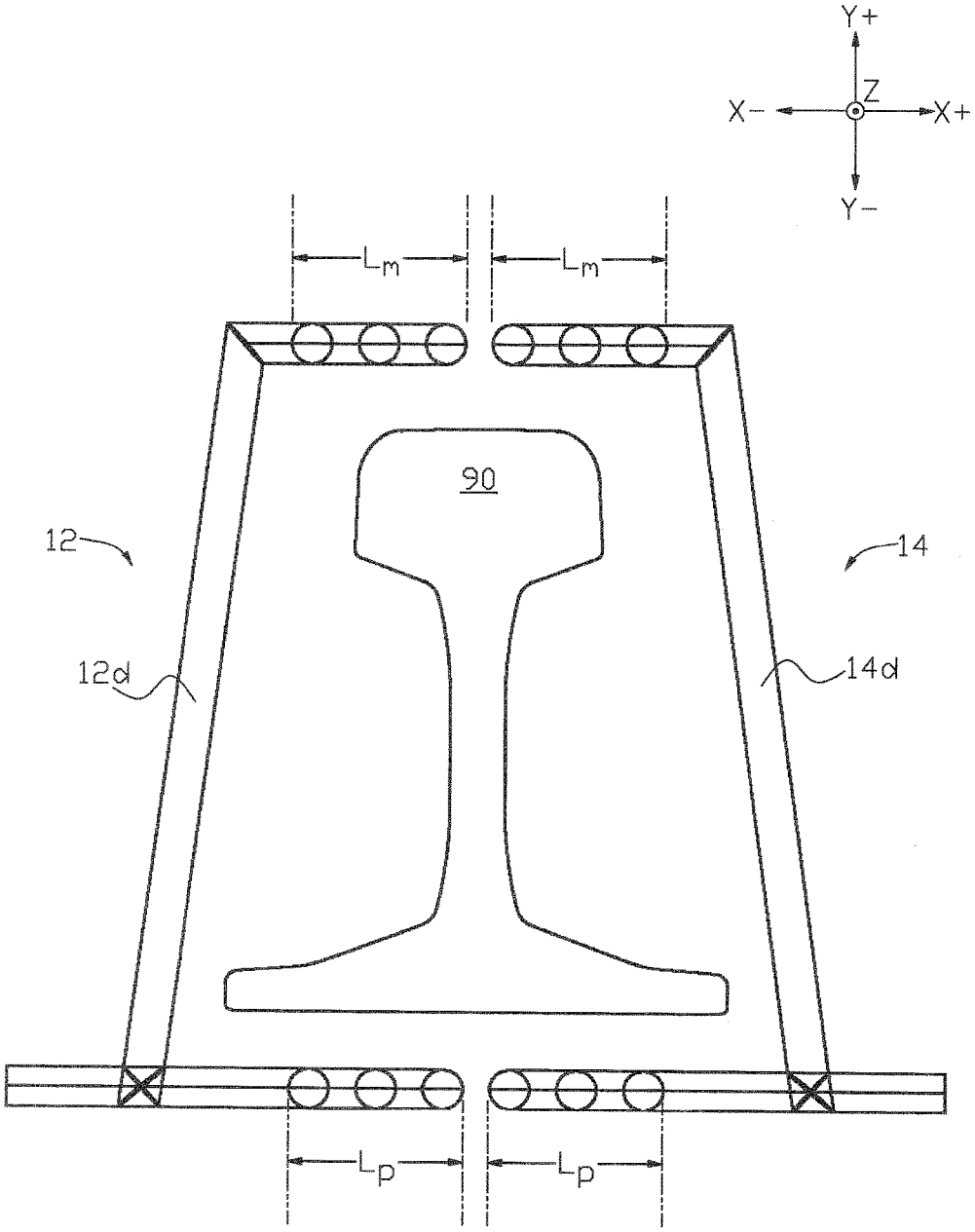
FIG. 8 is a cross sectional elevation view of the rail within the electric inductor rail heater shown in FIG. 5 looking towards the rear of the rail heater with illustration of the overall horizontal widths of the top (width $L_m$) and bottom (width Lp) longitudinal coil sections for a three-turn coil electric inductor rail heater.
Figure 9:
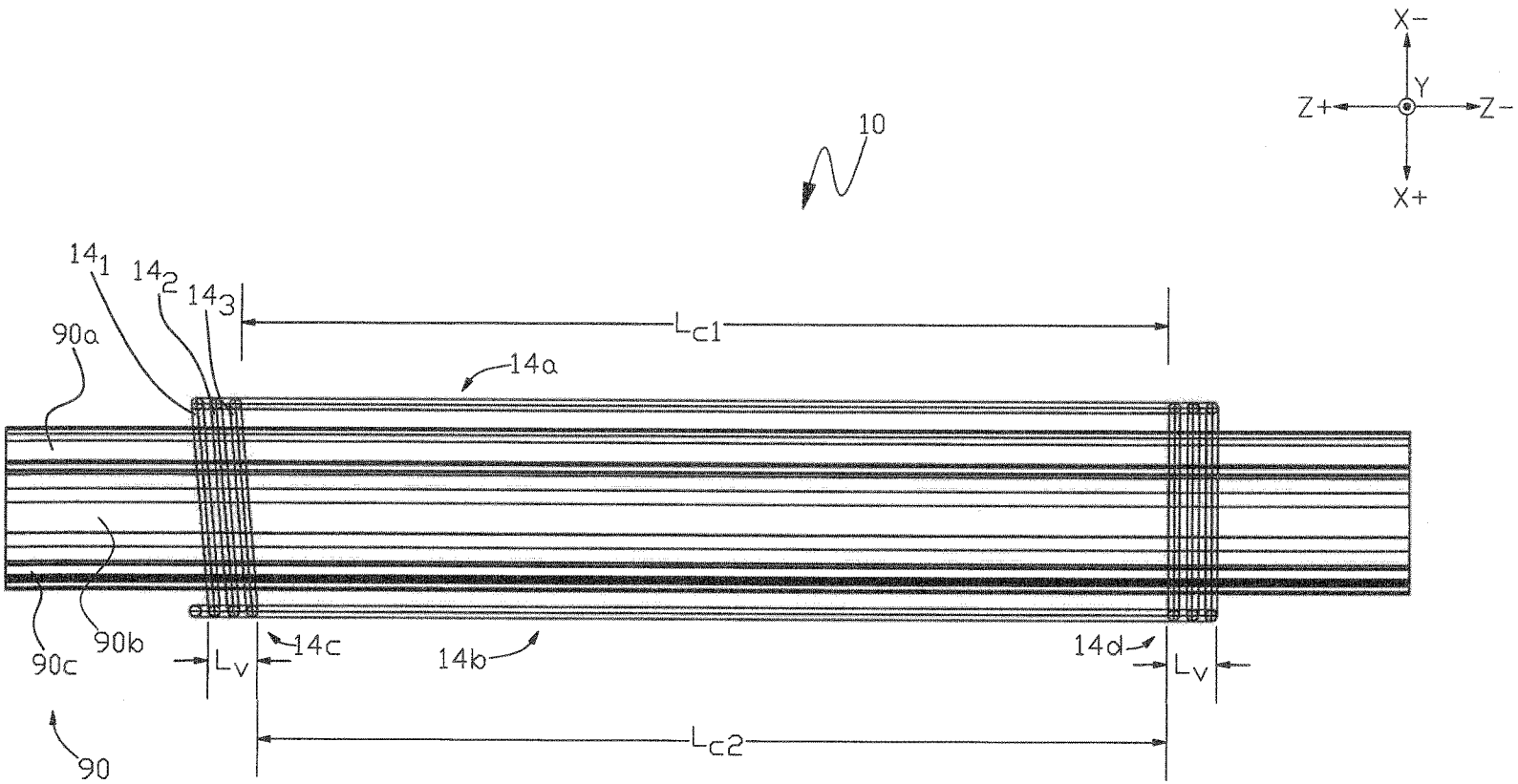
FIG. 9 is a longitudinal elevation view of the rail within the electric inductor rail heater shown in FIG. 5 with illustration of the overall longitudinal lengths of the top (length $L_{c1}$) and bottom (length $L_{c2}$) longitudinal coil sections and the riser coil sections ($L_v$) on one of the two coils forming the inductor rail heater.

Separation distances of the coil sections for multi-turn coils 12 and 14 are selected to avoid deformation of the rail head, web and foot by differential heating. In this example of the invention: the top (upper) longitudinal coil sections overall coil width $L_m$ (in the X-direction) as shown in FIG. 8 is selected to control the rate of induced heating of the rail head; the lower longitudinal coil sections overall coil width $L_p$ (in the X-direction) as shown in FIG. 8 is selected to control the rate of induced heating of the rail foot; the overall longitudinal length of the riser sections $L_v$ (in the Z-direction) as shown in FIG. 9 for front riser coil section 14*c* and rear riser coil section 14*d* of coil 14 is selected to control the rate of induced heating of the rail web; and the overall longitudinal length of the top ($L_{c1}$) and bottom ($L_{c2}$) longitudinal sections (in the Z-direction) as shown in FIG. 9 is selected to control the rate of induced heating of the rail head and foot. Thus all of these coil dimensions ($L_m$, $L_p$, $L_v$, $L_{c1}$ and $L_{c2}$) for a multi-turn coil may be different from each other for a particular configuration of a rail.

Figure 5:
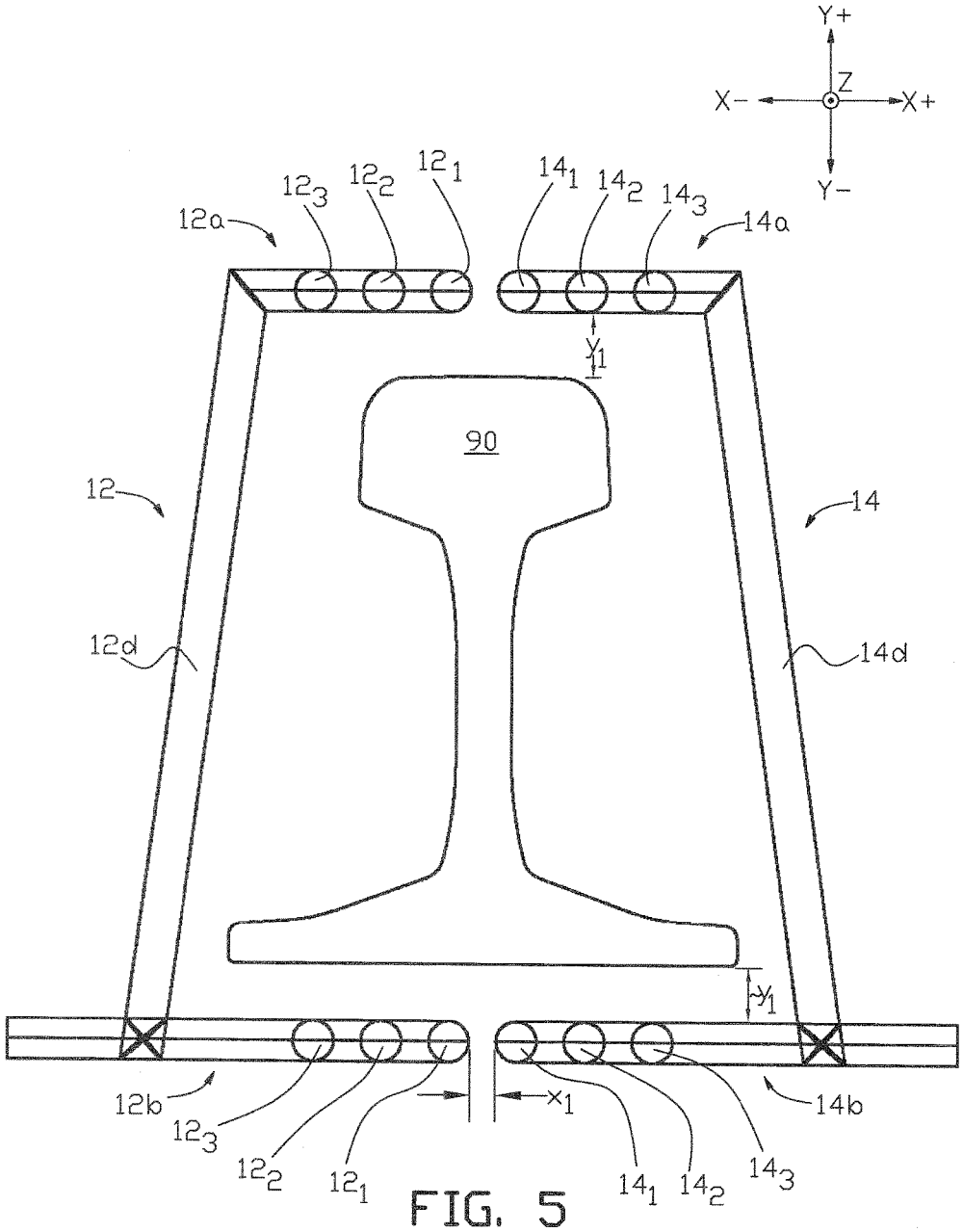
FIG. 5 is a cross sectional (transverse) elevation view of the rail within the electric inductor rail heater shown in FIG. 3 looking towards the rear of the rail heater.
Figure 6:
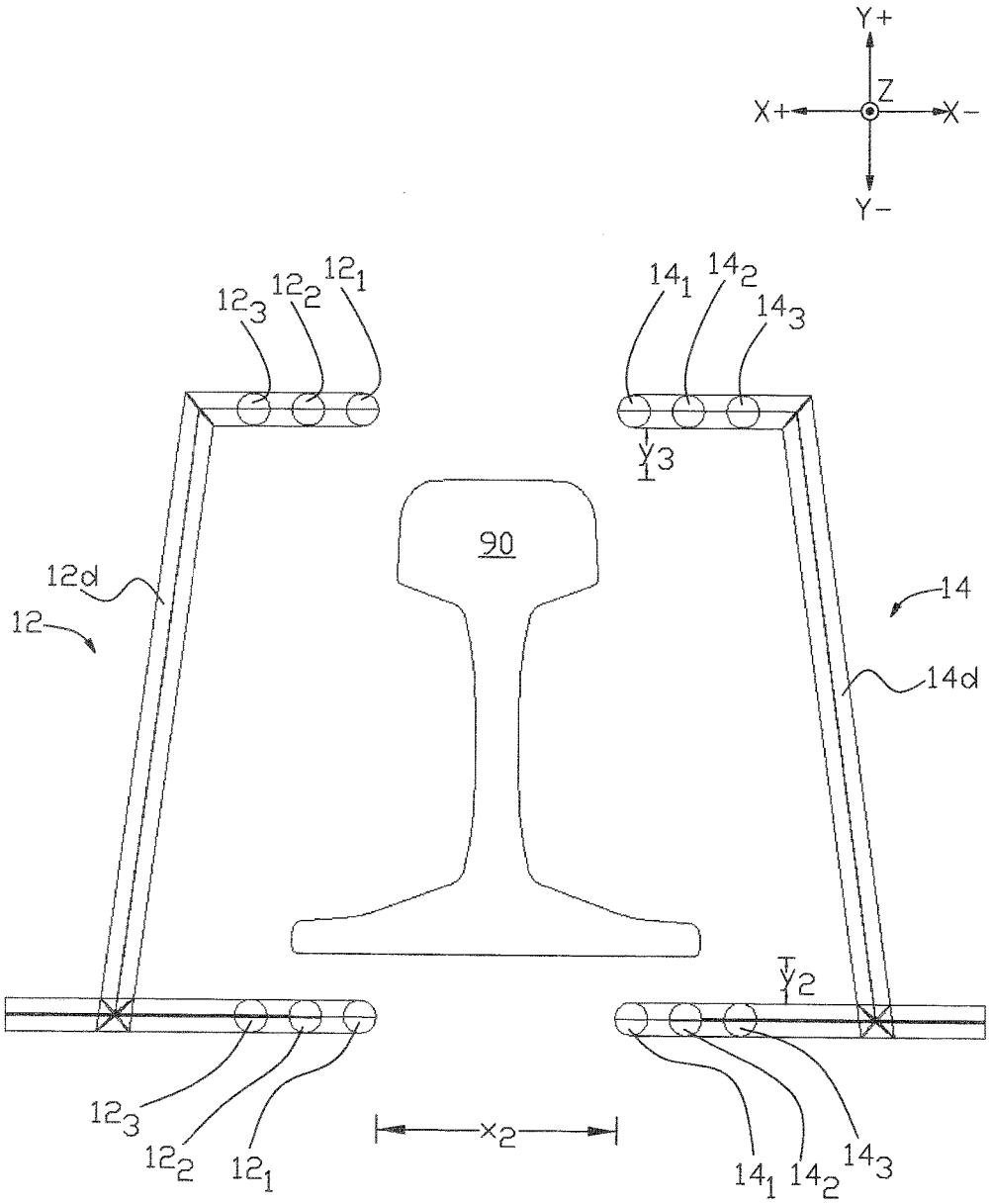
FIG. 6 is a cross sectional (transverse) elevation view of the rail within the electric inductor rail heater shown in FIG. 5 looking towards the rear of the rail heater with the heater's pair of coils in an adjustable horizontally separated position relative to the position of the rail.

For a fixed inductor arrangement according to the previous paragraph, one dynamic method of varying induced heating of the rail head, web and foot in the present invention is by connecting coils 12 and 14 to separate actuators (not shown in the figures) that allow movement of the coils in the X-direction as shown in FIG. 5 and FIG. 6. In FIG. 5 coils 12 and 14 are separated in the X-direction (transverse) by $x_1$ and in FIG. 6 by the larger distance of $x_2$. In one embodiment of the invention a transverse coil actuator apparatus is provided for changing the transverse separation distance between the right rail side coil 12 and the left rail side coil 14.

Figure 10:
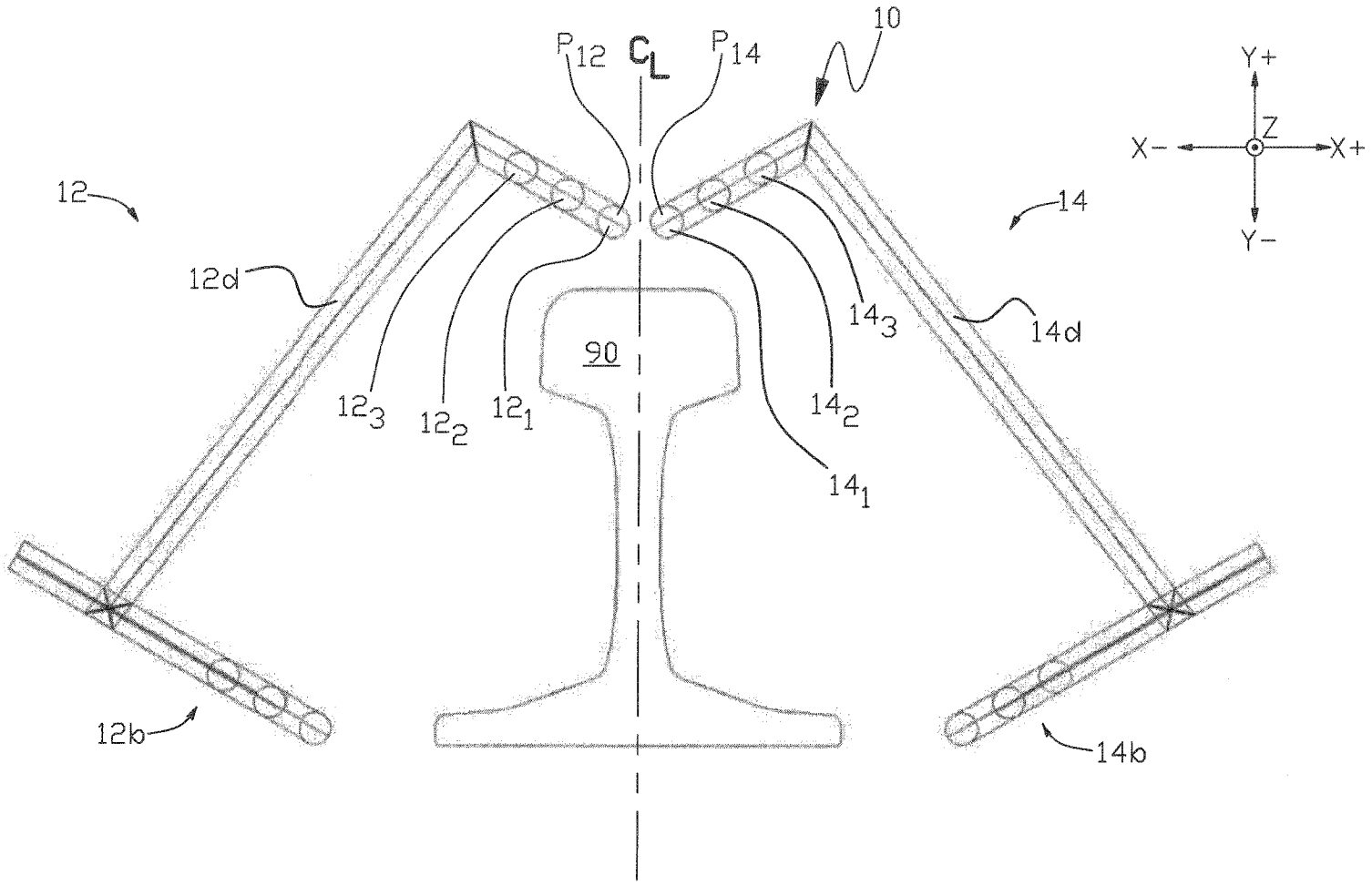
FIG. 10 is a cross sectional elevation view of the rail within the electric inductor rail heater shown in FIG. 5 looking towards the rear of the rail heater with the heater's pair of coils adjustably pivoted outwardly around the rail to reduce induced heating of the foot and the lower portion of the web and/or allow vertical removal of the rail from within the electric inductor rail heater.
Figure 11:
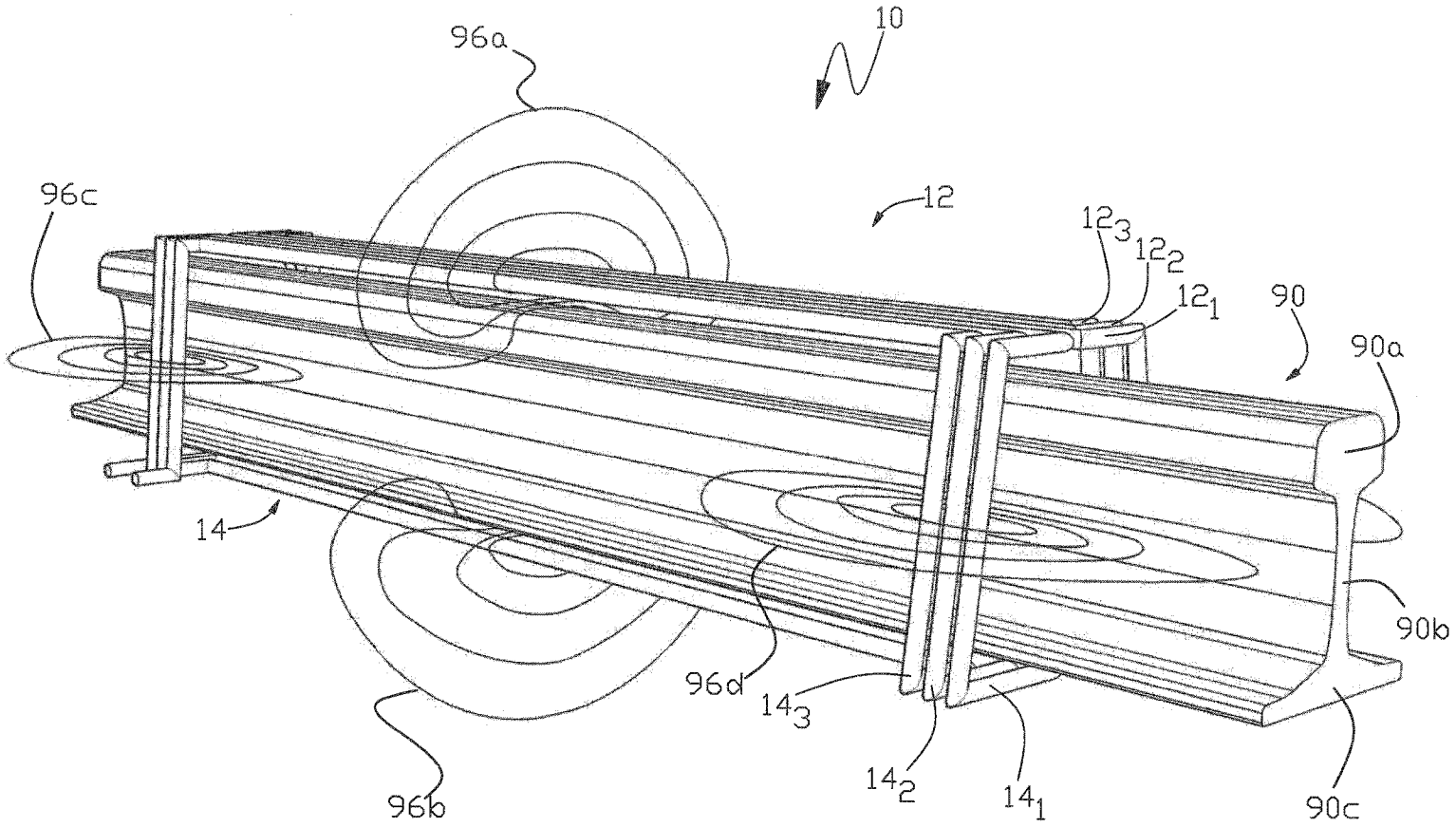
FIG. 11 illustrates typical distribution of magnetic flux densities with sample diagrammatic magnetic flux field lines for the arrangement shown in FIG. 3 when an alternating current is supplied to the electric inductor rail heater shown in FIG. 3.
Figure 12:
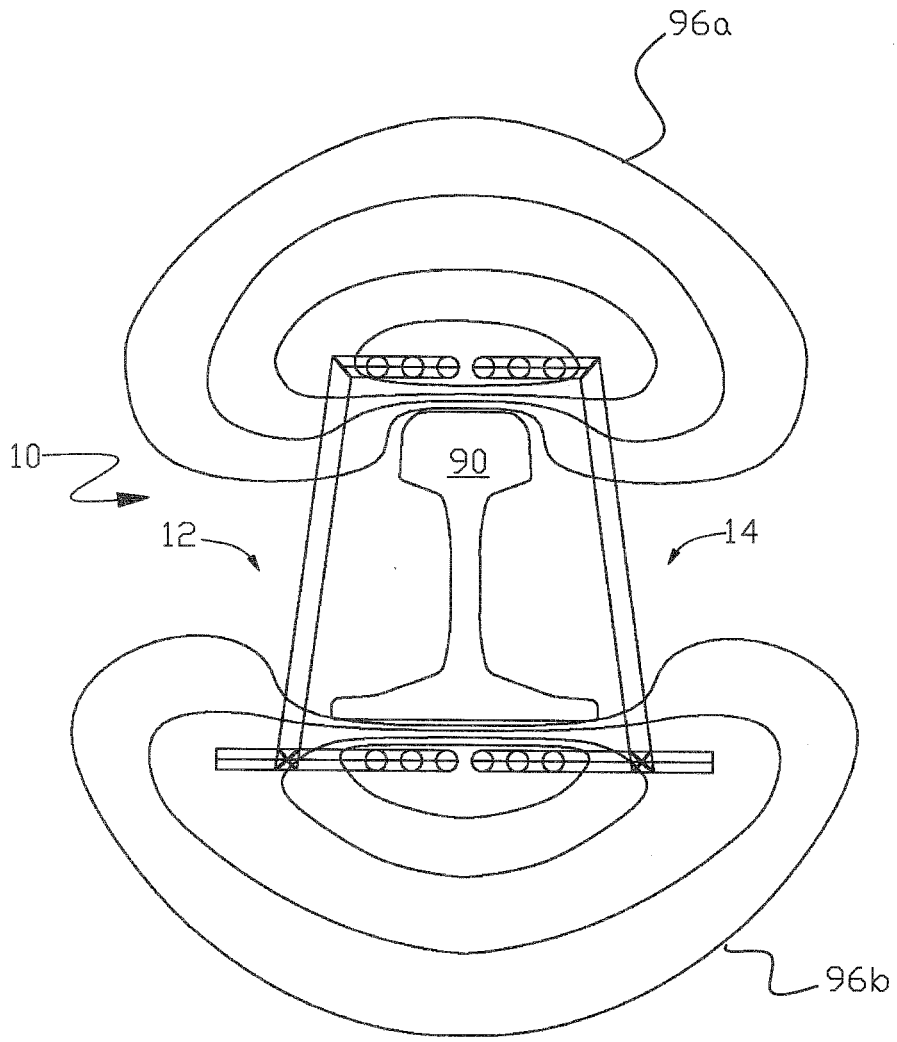
FIG. 12 illustrates typical distribution of magnetic flux densities with sample diagrammatic magnetic flux field lines around the top and bottom longitudinal coil sections for the arrangement shown in FIG. 5 when an alternating current is supplied to the electric inductor rail heater shown in FIG. 3.
Figure 13:
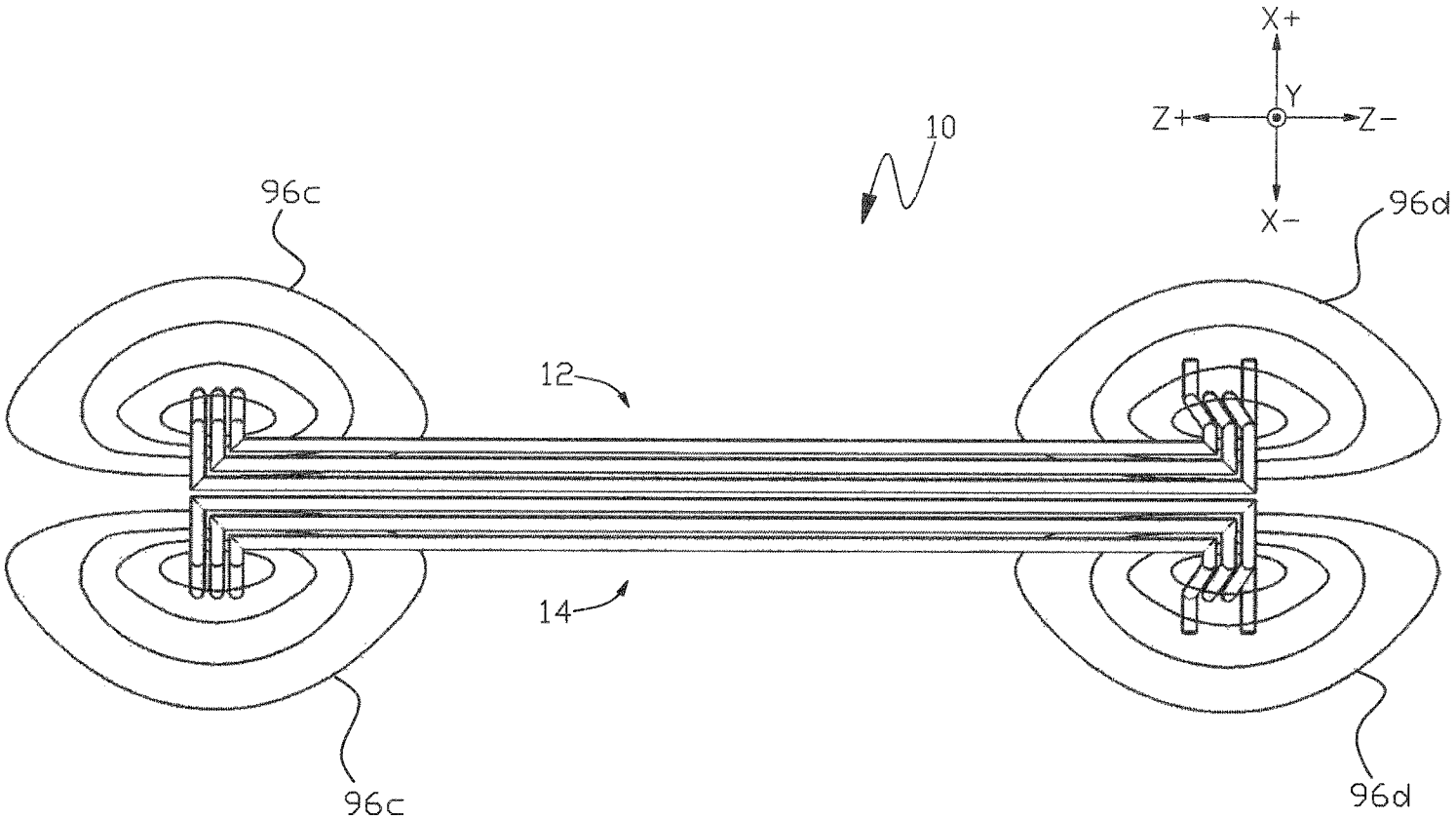
FIG. 13 illustrates typical distribution of magnetic flux densities with sample diagrammatic magnetic flux field lines around the riser coil sections for the arrangement shown in FIG. 3 when an alternating current is supplied to the electric inductor rail heater shown in FIG. 3.

An alternate method of dynamically altering the ratio of induced heating of the rail head, web and foot is by connecting coils 12 and 14 to actuators (not shown in the figures) that allow pivoting of the pair of coils 12 and 14 around the center line $C_L$ of the rail as shown in FIG. 10, for example, with pivoting axes $P_{12}$ and $P_{14}$ about coil turns $\mathbf{12}_1$ and $\mathbf{14}_1$ respectively. In one embodiment of the invention a transverse coil pivoting actuator apparatus is provided for changing a transverse separation distance between the right lower longitudinal coil section 12*b* and the left lower longitudinal coil section 14*b*.

Figure 7:
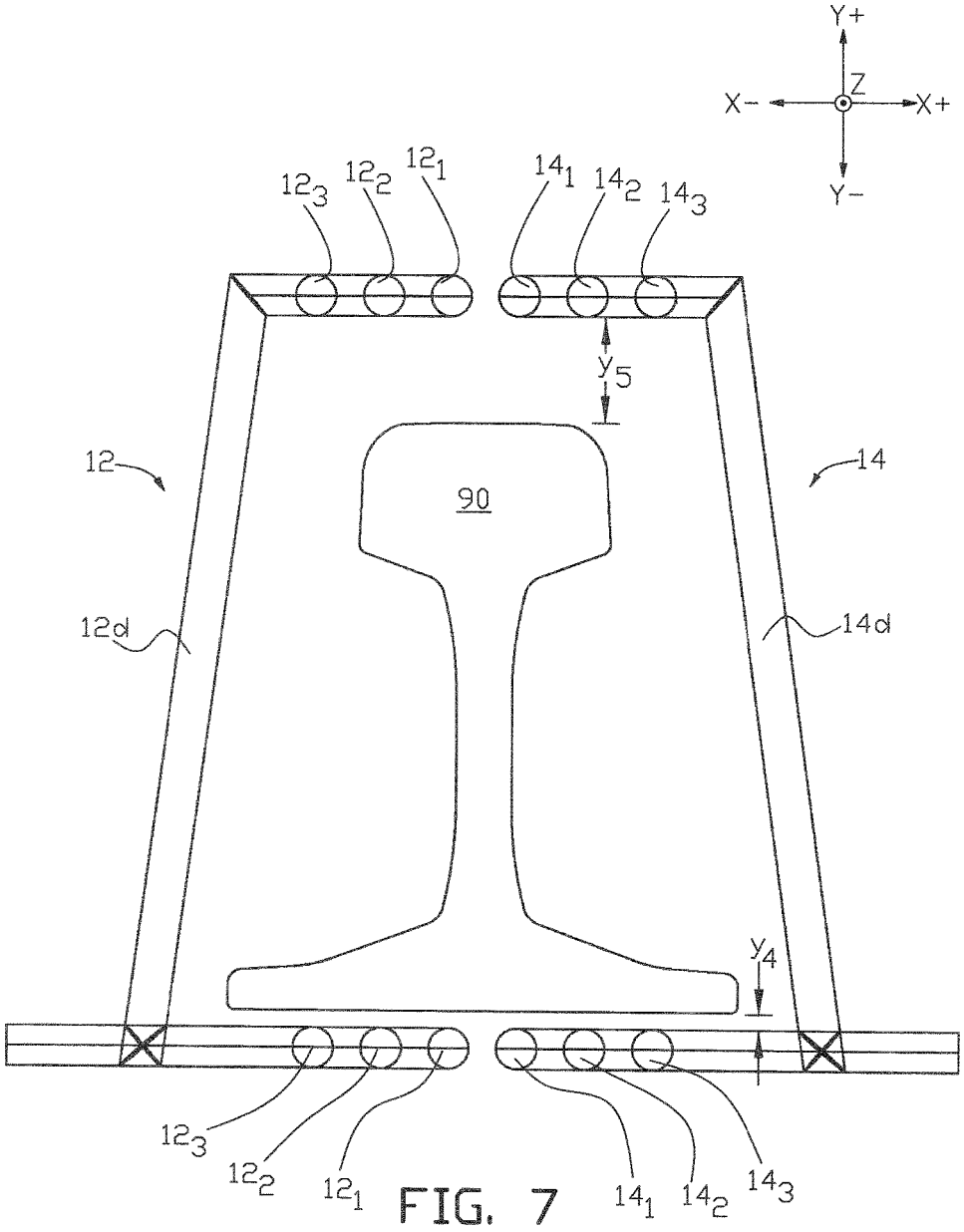
FIG. 7 is a cross sectional (transverse) elevation view of the rail within the electric inductor rail heater shown in FIG. 5 looking towards the rear of the rail heater with the heater's pair of coils in an adjustable vertically raised position relative to the position of the rail.

Another alternate method of dynamically altering the ratio of induced heating of the rail head, web and foot is by connecting the electric inductor rail heater to an actuator (not shown in the figures) that allow vertical movement of the heater in the Y-direction relative to the rail as shown in FIG. 5 and FIG. 7 where in FIG. 5 the head and foot of rail 90 are equally spaced apart, respectively, from the top (12*a* and 14*a*) and bottom (12*b* and 14*b*) longitudinal coil sections by distance $y_1$, and in FIG. 7 the bottom of the foot of the rail is closer to the bottom longitudinal sections with separation of distance $y_4$ and the top of the head of the rail is farther from the top longitudinal sections with separation of distance $y_5$; alternatively the electric inductor rail heater may remain stationary and a rail conveyance apparatus may adjust the height of the rail within the rail heater. In some examples of the invention two or more of the above methods of dynamically adjusting the spatial relationship between the electric inductor rail heater and rail may be used.

Another alternate method of dynamically altering the ratio of induced heating of the rail head, web and foot is by making the top and bottom longitudinal, risers and/or transition (if used) coil sections of the rail heater from telescoping inductor segments that can be extended or retracted as required for a particular rail cross sectional heating profile.

An additional advantage of the above horizontal (X-direction) or pivoting separation of the pair of coils is the ability to remove a rail from within the rail heater or to move the rail heater to a rail in another location.

If separate power supplies are used to supply power to coils 12 and 14, power magnitudes may be varied between the two sides of the rail, for example where the rail is an unsymmetrical rail as described above.

Figure 14:
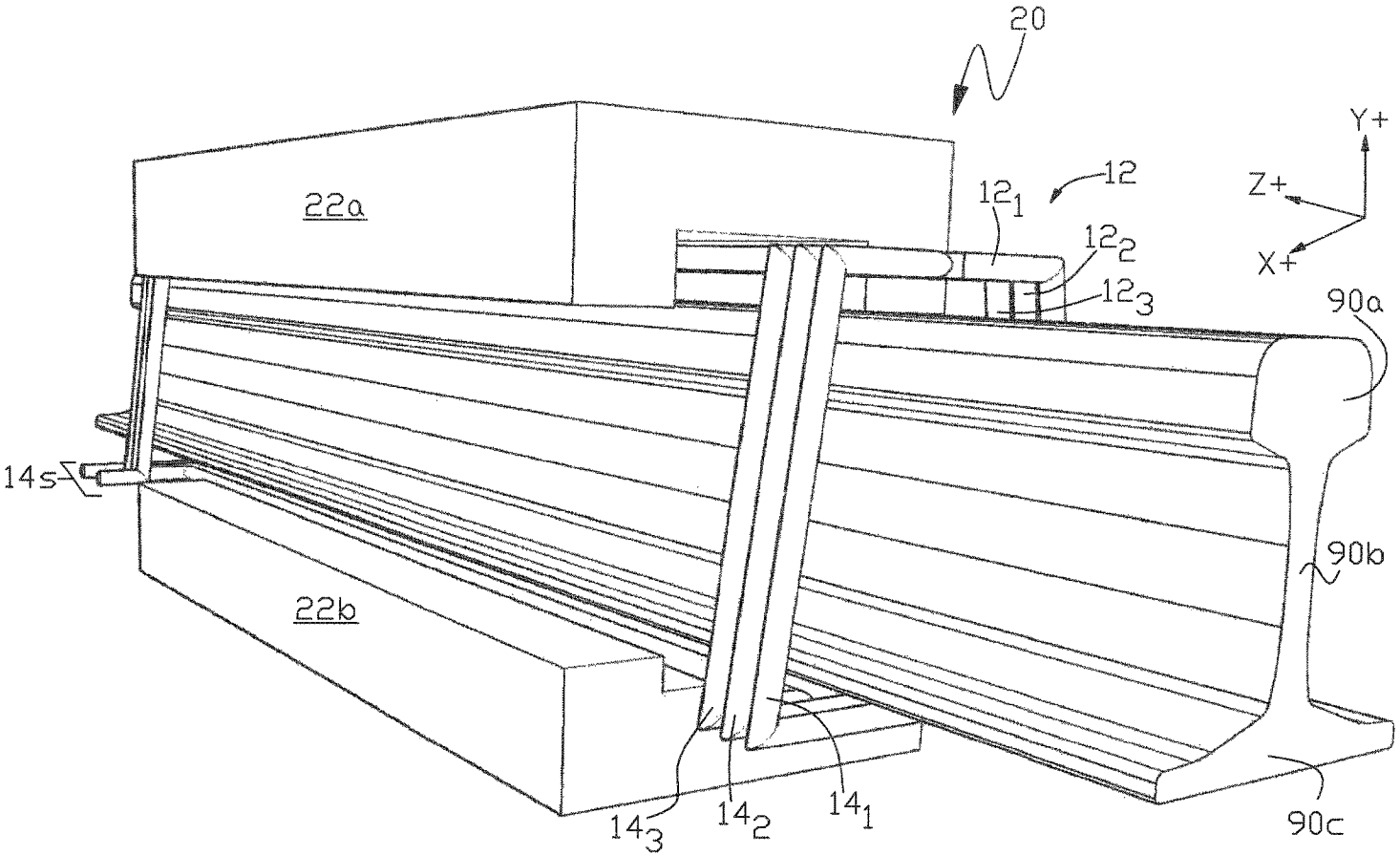
FIG. 14 illustrates the arrangement of the transverse flux electric induction rail heater in FIG. 3 with separate magnetic "C" cores above and around the sides of the top longitudinal coil sections and below and around the sides of the bottom longitudinal coil sections of the electric induction rail heater shown in FIG. 3.
Figure 15:
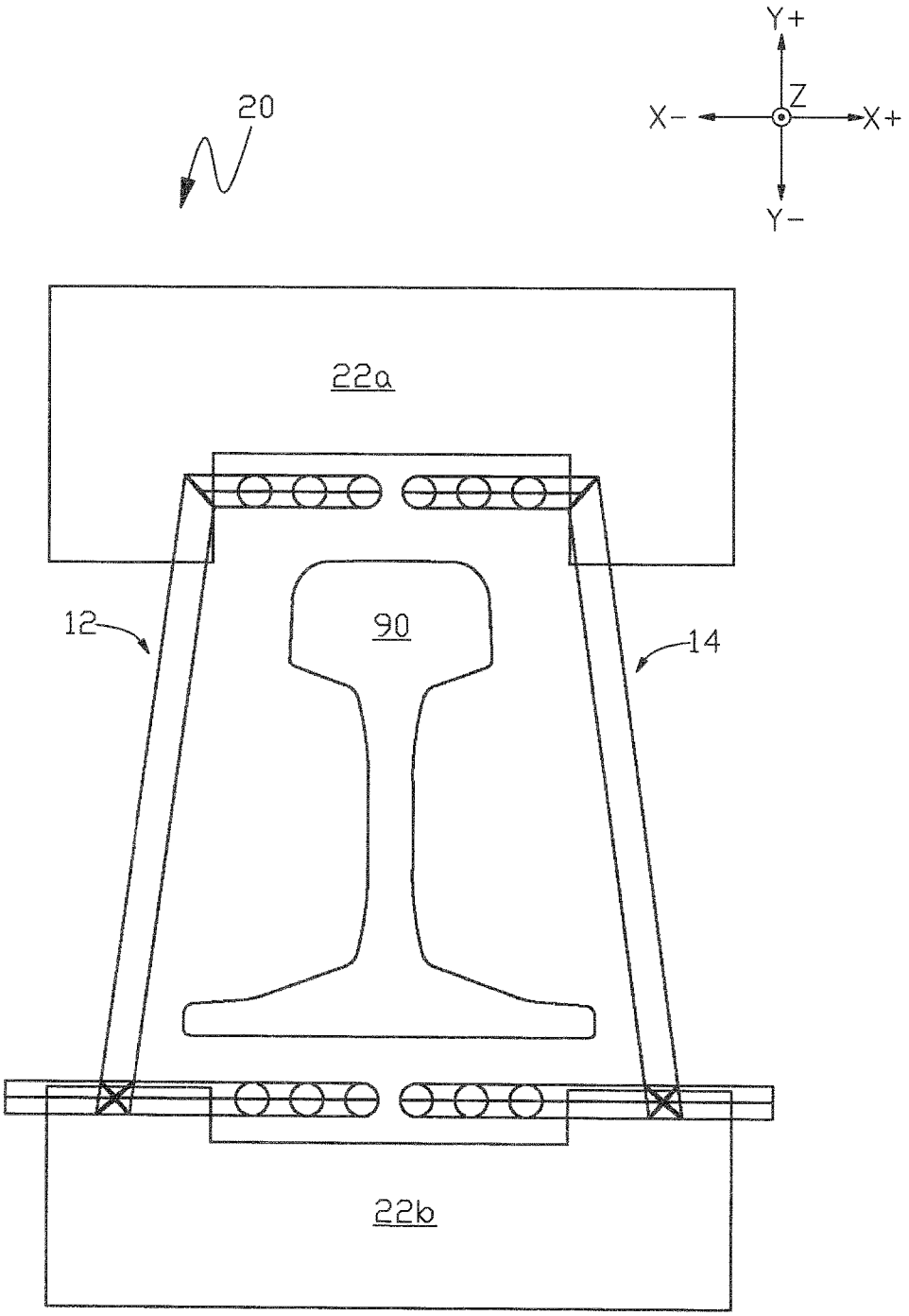
FIG. 15 is a cross sectional (transverse) elevation view of the rail within the electric inductor rail heater shown in FIG. 14.
Figure 16:
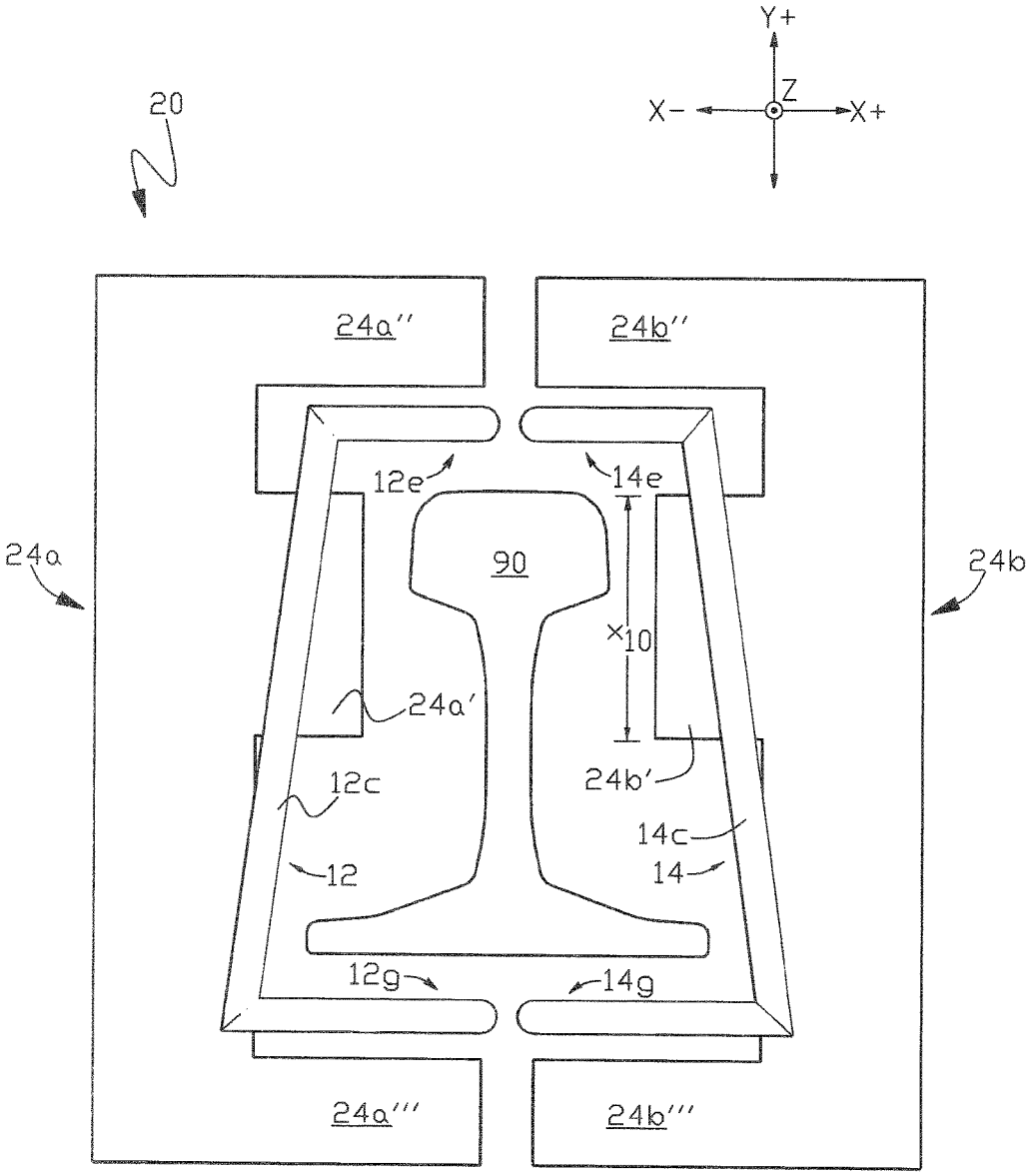
FIG. 16 is a front end elevation view of the arrangement in FIG. 3 with the addition of magnetic flux "E" cores above and around the outward sides of the top longitudinal coil sections and below and around the outward sides of the bottom longitudinal coil section of the electric induction rail heater shown in FIG. 3.
Figure 17:
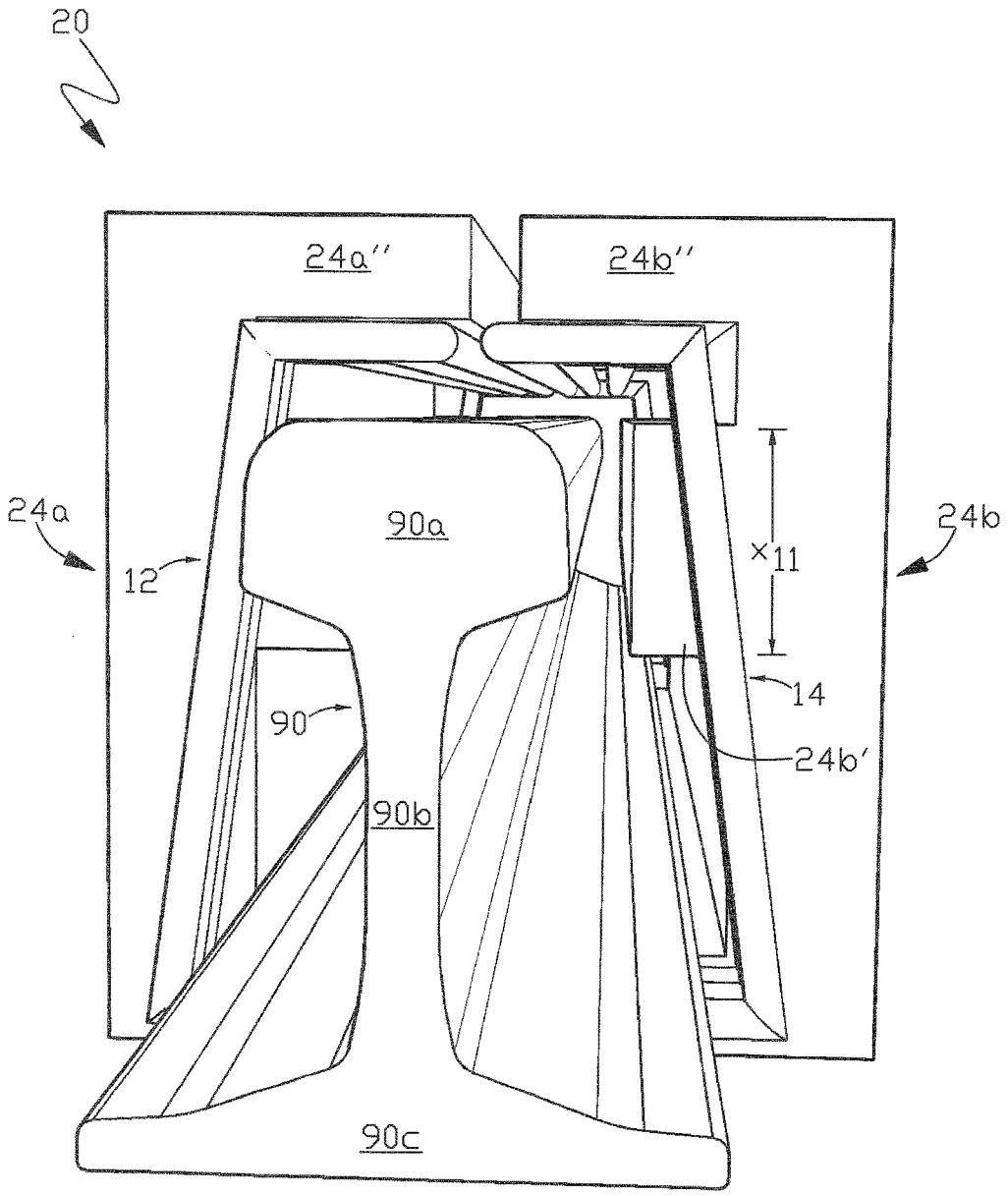
FIG. 17 is a perspective front end view of the electric inductor rail heater arrangement in FIG. 16 with the addition of the magnetic flux "E" cores.

Alternative transverse flux electric inductor rail heater 20 is shown in FIG. 14 through FIG. 17 and FIG. 22 where magnetic cores (formed from a magnetic material with a high permeability) in different configurations are used to adjust induced power sharing between the rail head, web and foot of the rail passing through the inductor heater. In FIG. 14 and FIG. 15 separate upper and lower magnetic "C" cores 22*a* and 22*b*, respectively, are provided above and around the sides of the top (upper) longitudinal coil sections (12*a*; 14*a*) and below and around the sides of the bottom (lower) longitudinal coil sections (12*b*; 14*b*) of coils 12 and 14. In FIGS. 16 and 17 separate magnetic "E" cores 24*a* and 24*b* are provided on opposing sides of the rail passing through the transverse flux electric induction rail heater with top end legs 24*a*" and 24*b*" over the top longitudinal coil sections 12*a* and 14*a*, and with bottom end legs 24*a*'" and 24*b*'" below bottom longitudinal coil sections 12*b* and 14*b* of each coil 12 and 14, with the center leg 24*a*' and 24*b*' of each magnetic core facing the side surface of the rail head and upper half of the rail web in FIG. 16 (vertical distance $x_{10}$) and the side surface of the rail head (vertical distance $x_{11}$) in FIG. 17. In this example of the invention, the right rail side magnetic "E" coil is disposed over the right (when viewing the rail and coil from the coil rear end riser coil sections (12*d* and 14*d*) to the front end riser coil sections (12*c* and 14*c*)) upper longitudinal coil section and extends down around the bottom of the right lower longitudinal coil section, with the center leg of the right side magnetic "E" coil extending within the space between the right front riser coil section and the right rear riser coil section, and the left rail side magnetic "E" coil is disposed over the left (when viewing the rail and coil from the coil rear end riser coil sections (12*d* and 14*d*) to the front end riser coil sections (12*c* and 14*c*)) upper longitudinal coil section and extends down around the bottom of the left lower longitudinal coil section, with the center leg of the left side magnetic "E" coil extending within the space between the left front riser coil section and the left rear riser coil section.

Figure 22:
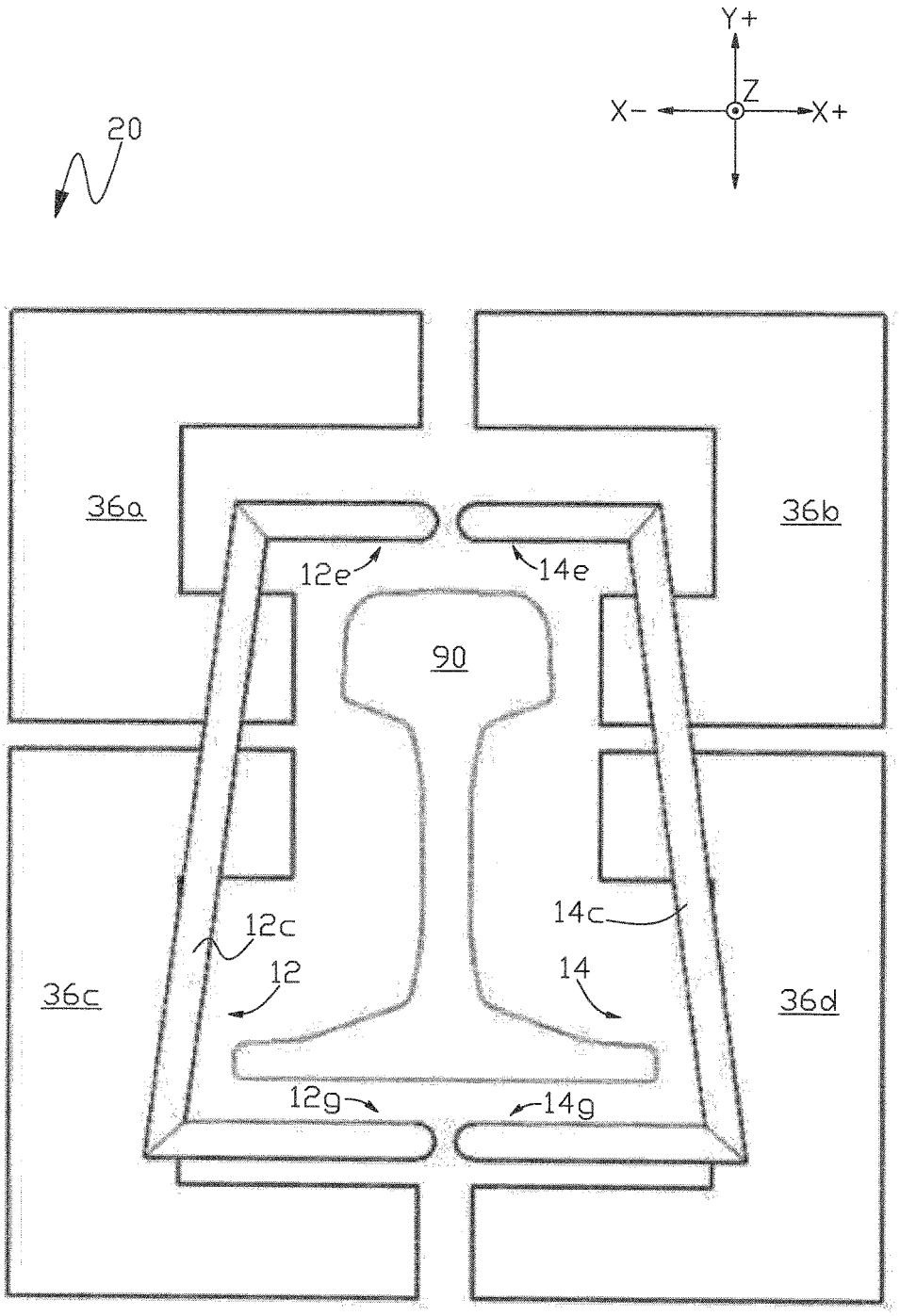
FIG. 22 illustrates a front end elevation view of the arrangement in FIG. 3 with the addition of four separate magnetic flux "C" cores above and around the outer sides of the top longitudinal coil section and below and around the outer sides of the bottom longitudinal coil section of the electric induction rail heater shown in FIG. 3.

In FIG. 22 four separate "C" cores 36*a* through 36*d* are used to achieve superior control of differential cross sectional magnetic flux linking between the head and the foot of the rail. In this embodiment of the transverse flux electric induction rail heater of the present invention, upper right rail side magnetic "C" core 36*a* is disposed around the right (when viewing the rail and coil from the coil rear end riser coil sections (12*d* and 14*d*) to the front end riser coil sections (12*c* and 14*c*)) upper longitudinal coil section with the bottom leg of the upper right rail side magnetic "C" core facing the right side of the head. Lower right rail side magnetic "C" core 36*c* is disposed around the right lower longitudinal coil section and the top leg of the lower right rail side magnetic "C" core faces the right side of the web. Upper left rail side magnetic "C" core 36*b* is disposed around the left upper longitudinal coil section, with the bottom leg of the upper left rail side magnetic "C" core facing the left side of the head, and lower left rail side magnetic "C" core 36*d* disposed around the left lower longitudinal coil section, the top leg of the lower right rail side magnetic "C" core facing the left side of the web. An independent actuator can be attached to each of the four "C" cores for moving each core independently for adjusted induced heating of the rail head, web and foot. In one embodiment a magnetic "C" core assembly adjustment apparatus is provided for independently adjusting each of the upper and lower right rail side magnetic "C" cores and the upper and lower left rail side magnetic "C" cores in the transverse and vertical directions.

The above transverse flux electric inductor rail heater is preferable for adjusting the induced heat in the rail head, web and foot. In another example of the present invention, electric induction rail heater 30 as shown in FIG. 18 through FIG. 21 is preferable where primarily induced heating of the rail head is required.

Figure 18:
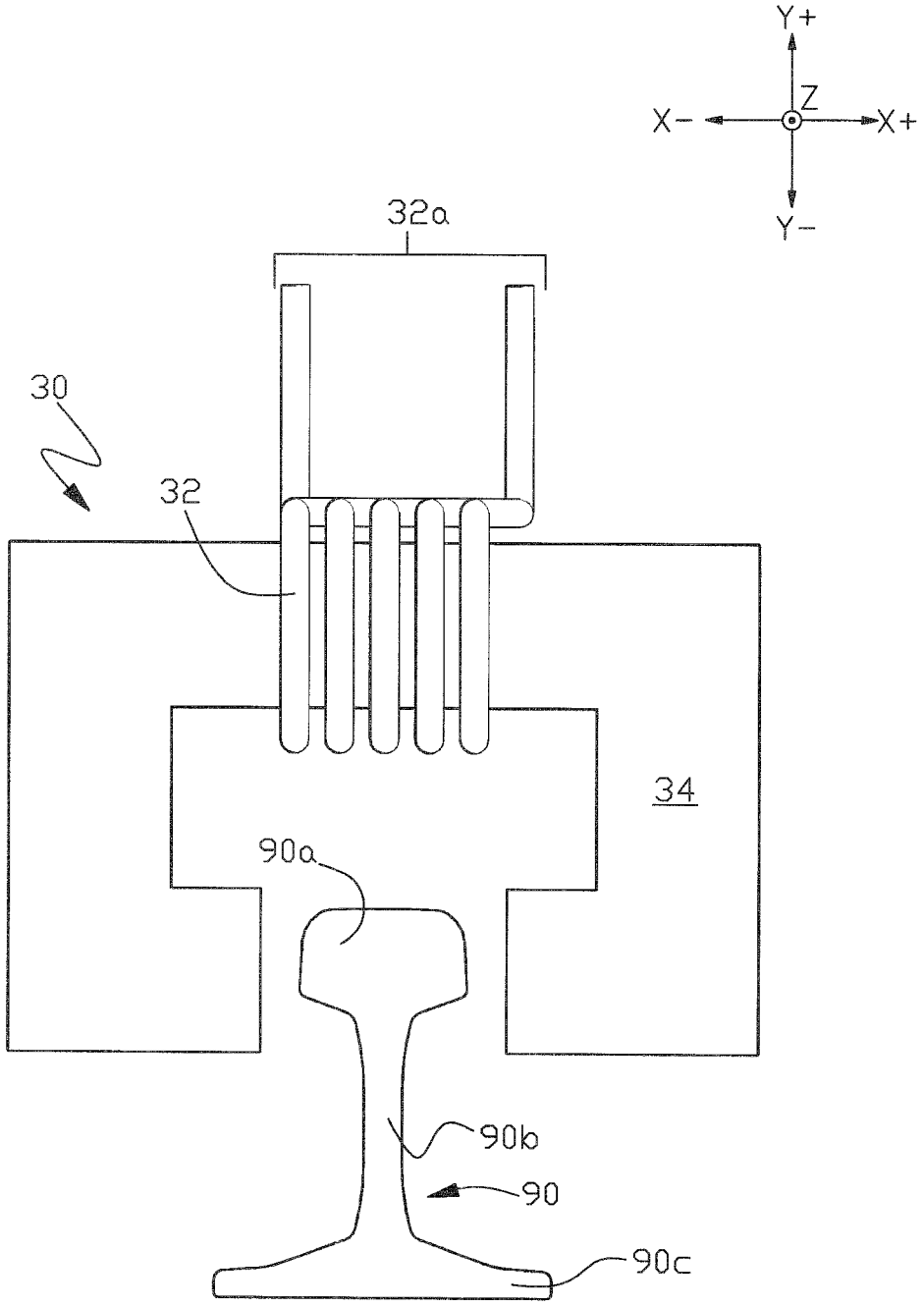
FIG. 18 illustrates a front end elevation view another example of an electric inductor rail heater with a magnetic flux "C" core around which a longitudinally oriented solenoidal coil is wound for connection to an alternating current source with the rail adjustably positioned within the opening of the "C" core.
Figure 19:
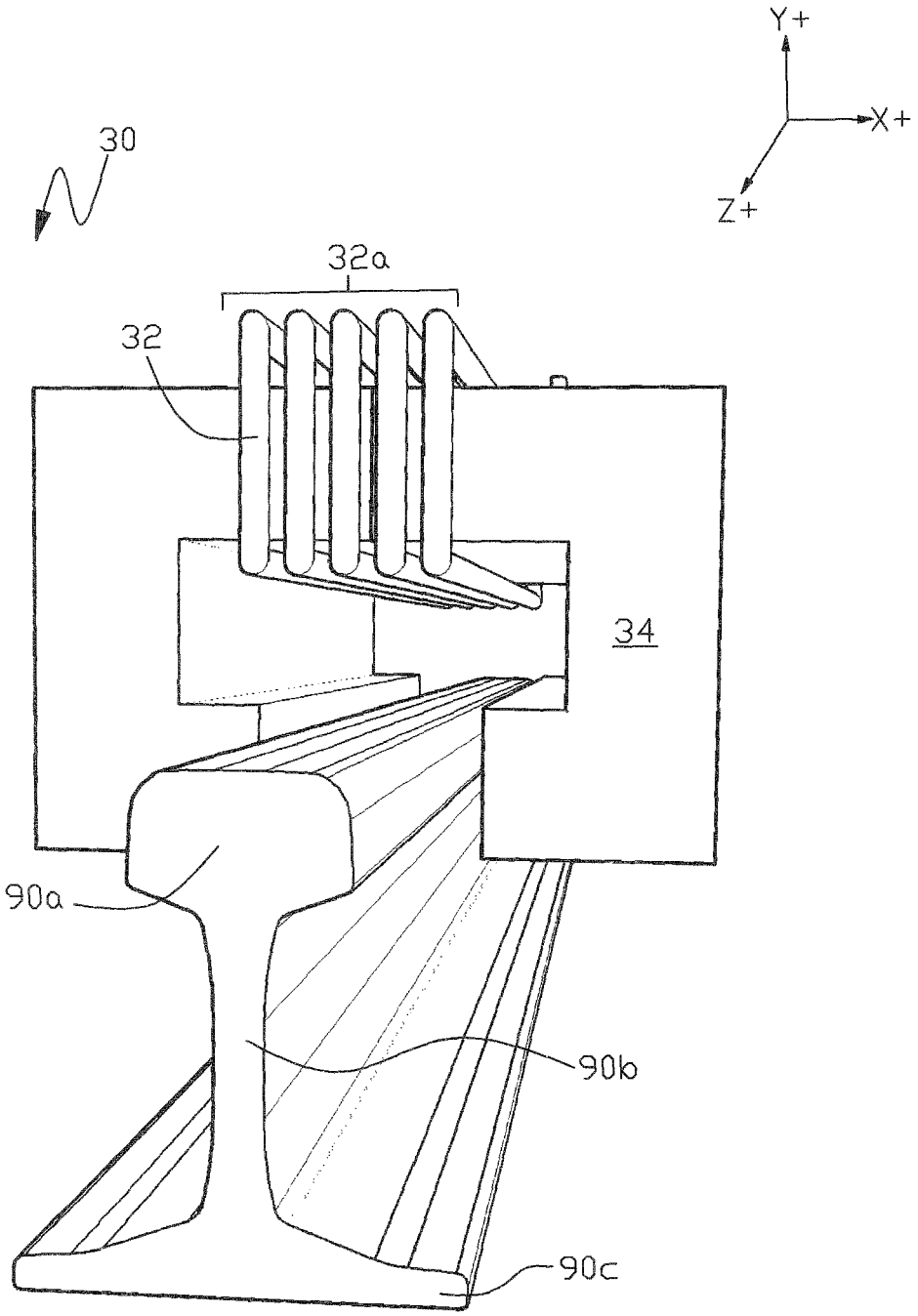
FIG. 19 is a perspective front end view of the electric inductor rail heater arrangement shown in FIG. 18.
Figure 20:
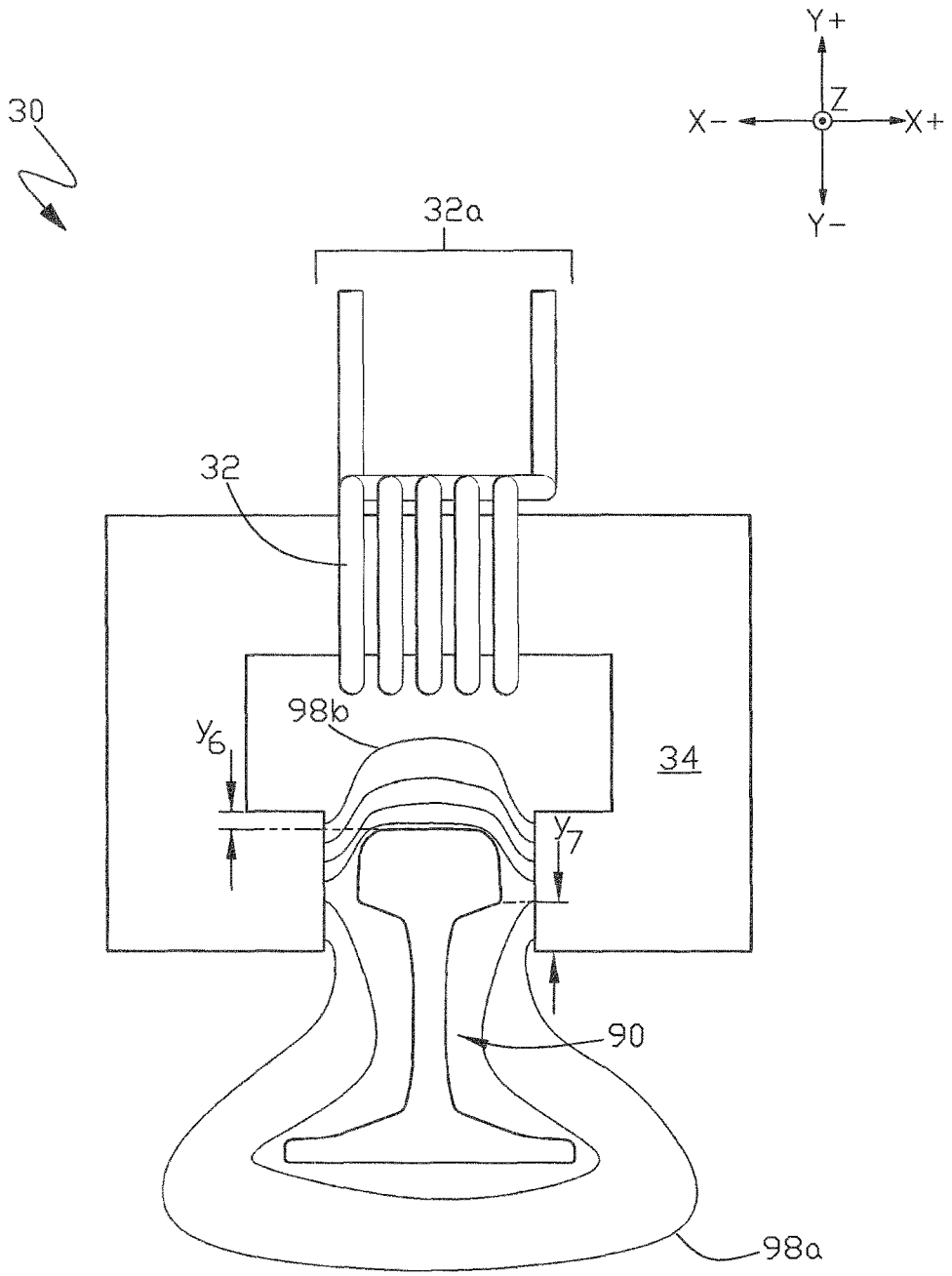
FIG. 20 illustrates typical distribution of magnetic flux densities with sample diagrammatic magnetic flux field lines for the arrangement shown in FIG. 18 and FIG. 19 when an alternating current is supplied to the electric inductor rail heater shown in FIG. 18 and FIG. 19 via the longitudinally oriented solenoidal coil.

Rail heater 30 comprises solenoidal coil 32 wound around a magnetic "C" core 34 and is disposed above rail 90 so that the rail head can be positioned within the opening in the magnetic "C" core as shown in FIG. 18 and FIG. 19. Alternating current is supplied from a suitable power source connected to coil terminals 32*a*. FIG. 20 illustrates typical distribution of magnetic flux densities with sample diagrammatic magnetic flux field lines 98*a* (two below the rail head) and 98*b* (four above and around the rail head) for the arrangement shown in FIG. 18 and FIG. 19 when an alternating current is supplied to the electric inductor rail heater shown in FIG. 18 and FIG. 19.

Rail 90 is moved through rail heater 30 by a suitable rail conveyance apparatus. Alternatively rail heater 30 may move along a stationary rail or both the rail heater and rail may simultaneously move in opposing directions during the induction heating process.

Figure 21:
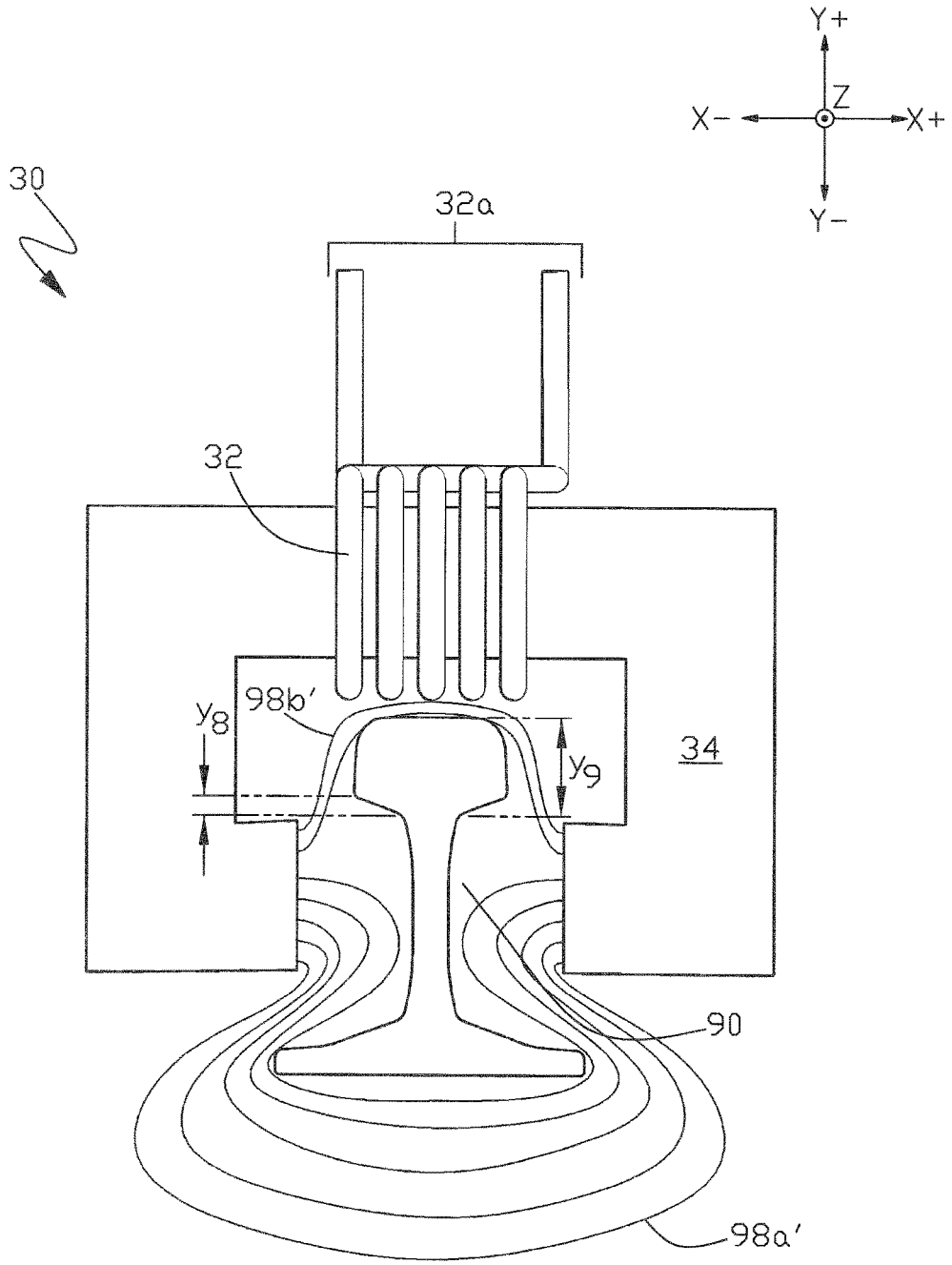
FIG. 21 illustrates typical distribution of magnetic flux densities with sample diagrammatic magnetic flux field lines for the arrangement shown in FIG. 18 when an alternating current is supplied to the electric inductor rail heater shown in FIG. 18 and the electric inductor rail heater is vertically lowered relative to the position of the rail.

In some examples of the invention rail heater 30 can be connected to an actuator (not shown in the drawings) to move the heater in the vertical Y-direction relative to the rail as shown in FIG. 20 and FIG. 21 to adjust the ratio of induced heat in the rail head, web and foot as indicated by the sample diagrammatic magnetic flux field lines. In FIG. 20 the flux field is concentrated around the top of the rail's head whereas in FIG. 21 the flux field concentration moves further down to the web and foot sections of the rail as indicated by the shift downwards in concentration of magnetic flux field lines 98*a* and 98*b* in FIG. 20 to magnetic flux lines 98*a*' and 98*b*' in FIG. 21. Alternatively the rail conveyance apparatus can be arranged to raise and lower the head of the rail within a stationary rail heater.

Figure 26:
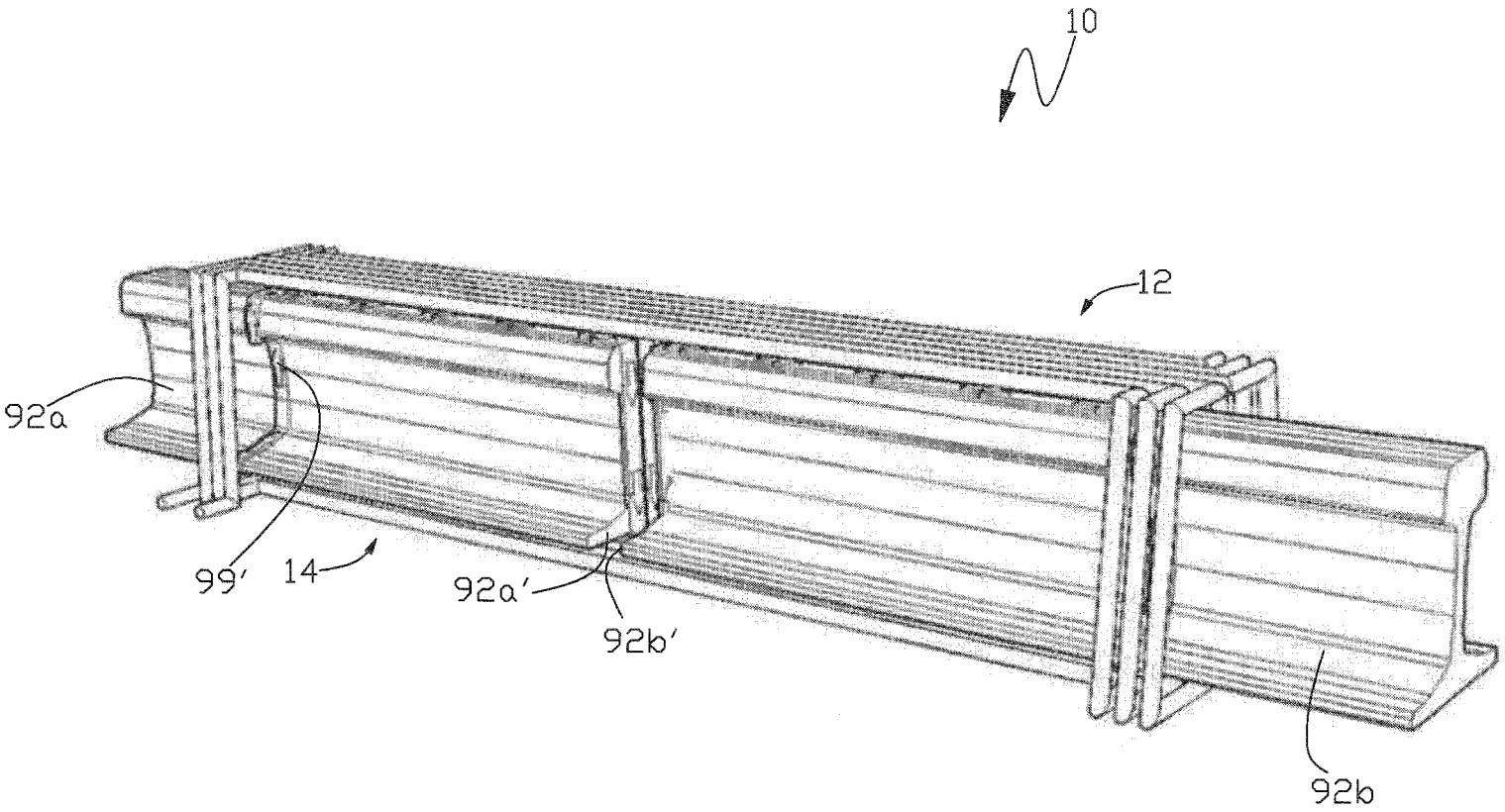
FIG. 26 is a perspective view of one example of an electric inductor rail heater of the present invention (as illustrated in FIG. 2) for heating the opposing ends of two rail sections prior to welding the opposing ends of the two rail sections together with diagrammatic arrows illustrating the direction of induced instantaneous currents flowing in the opposing ends of the two rail sections.
Figure 27:
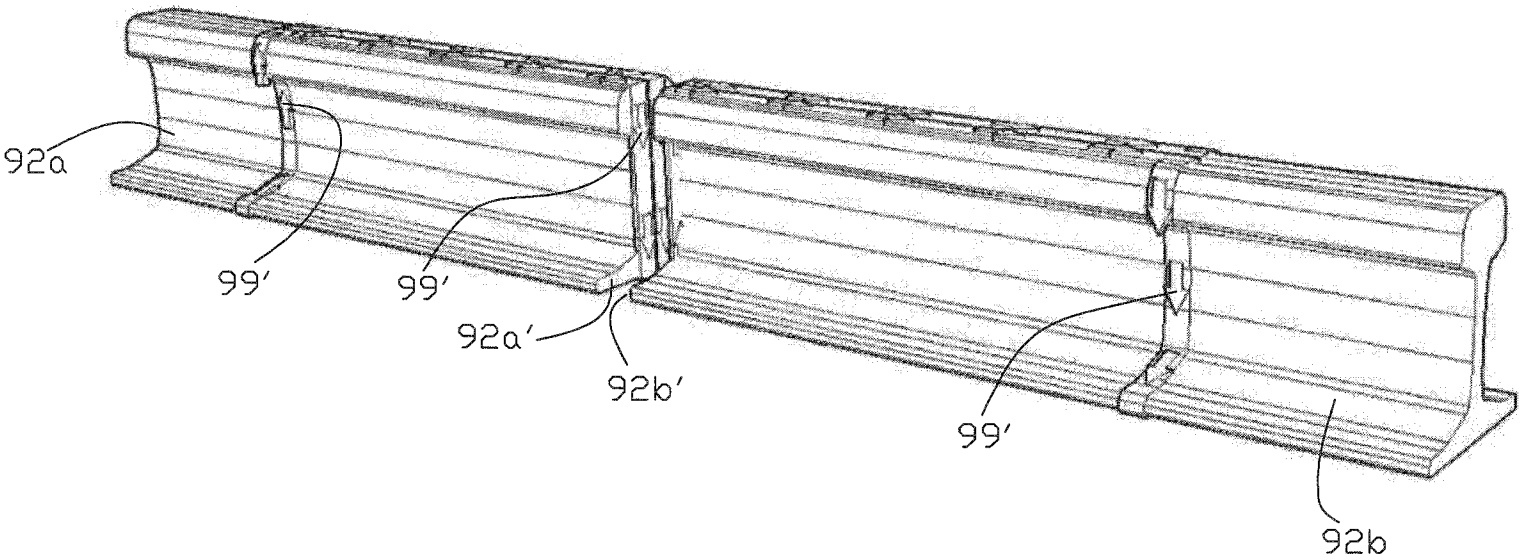
FIG. 27 illustrates with diagrammatic arrows the direction of induced instantaneous current flows in the opposing ends of the two rail sections in FIG. 26 with the electric inductor rail heater removed for clarity.
Figure 28:
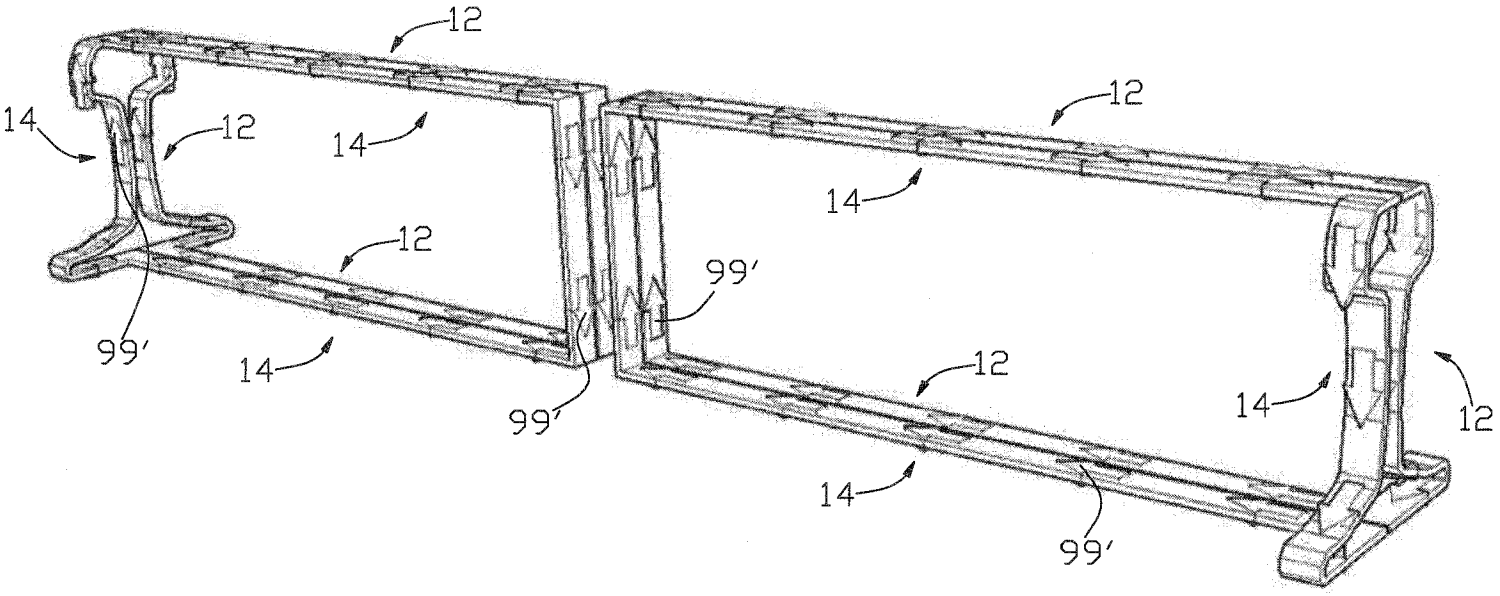
FIG. 28 illustrates with diagrammatic arrows the direction of induced instantaneous current flows in the opposing ends of the two rail sections with the electric inductor rail heater and the opposing ends of the two rail sections removed for clarity.

In another example of the invention transverse flux electric inductor rail heater 10 is used to inductively heat the opposing ends 92*a*' and 92*b*' of rails 92*a* and 92*b* as shown in FIG. 26. The instantaneous directions of induced current flows are illustrated by diagrammatic arrows 99' in FIG. 26 through FIG. 28.

In the descriptions above, for the purposes of explanation, numerous specific requirements and several specific details have been set forth in order to provide a thorough understanding of the example and embodiments. It will be apparent however, to one skilled in the art, that one or more other examples or embodiments may be practiced without some of these specific details. The particular embodiments described are not provided to limit the invention but to illustrate it.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention.

The invention claimed is:

1. A transverse flux electric induction rail heater for inductively heating a longitudinal section of a rail passing through the transverse flux electric induction rail heater, the rail having a head joined to a foot by a web, the rail having a first side and a second side oriented on opposing cross sectional sides of the rail, the transverse flux electric induction rail heater comprising:

a right rail side coil disposed adjacent to the first side of the rail, the right rail side coil comprising:

a right upper longitudinal coil section disposed parallel to the longitudinal section of the rail and located adjacently above the first side of the head;

a right lower longitudinal coil section disposed parallel to the longitudinal section of the rail and located adjacently below the first side of the foot;

a right front riser coil section disposed adjacently to the first side of the rail and oriented perpendicular to the longitudinal section of the rail, the right front riser coil section connecting a front adjacent ends of the right upper and lower longitudinal coil sections; and a right rear riser coil section disposed adjacently to the first side of the rail and oriented perpendicular to the longitudinal section of the rail, the right rear riser coil section connecting a rear adjacent ends of the right upper and lower longitudinal coil sections;

whereby the right rail side coil forms at least a first one turn coil along the first side of the rail;

and a left rail side coil disposed adjacent to the second side of the rail, the left rail side coil comprising:

a left upper longitudinal coil section disposed parallel to the longitudinal section of the rail and located adjacently to the right upper longitudinal coil section above the second side of the head;

a left lower longitudinal coil section disposed parallel to the longitudinal section of the rail and located adjacently to the right lower longitudinal coil section below the second side of the foot;

a left front riser coil section disposed adjacently to the second side of the rail and oriented perpendicular to the longitudinal section of the rail, the left front riser coil section connecting a front adjacent ends of the left upper and lower longitudinal coil section ends; and a left rear riser coil section disposed adjacently to the second side of the rail and oriented perpendicular to the longitudinal section of the rail, the left rear riser coil section connecting a rear adjacent ends of the left upper and lower longitudinal coil sections;

whereby the left rail side coil forms at least a second one turn coil along the second side of the rail.

2. The transverse flux electric induction rail heater of claim 1 further comprising a transverse flux electric induction rail heater conveyance apparatus and/or a rail conveyance apparatus to create a relative motion of the transverse flux electric induction rail heater and/or the rail so that the longitudinal section of the rail passing through the transverse flux electric rail heater changes during a rail section time period.

3. The transverse flux electric induction rail heater of claim 1 further comprising at least one alternating current power source connect to the right rail side coil and the left rail side coil.

4. The transverse flux electric induction rail heater of claim 1 wherein:

the right upper longitudinal coil section has a front right upper longitudinal coil section end and a rear right upper longitudinal coil section end;

the right lower longitudinal coil section has a front right lower longitudinal coil section end and a rear right lower longitudinal coil section end, the front right lower longitudinal coil section end connected to a first power termination;

the right front riser coil section has a first right front riser coil section end and a second right front riser coil section end, the second right front riser coil section end opposing the first right front riser coil section end, the first right front riser coil section end connected to the front right upper longitudinal coil section end by a first right transition coil section and the second right front riser coil section end disposed adjacent to the front right lower longitudinal coil section end and connected to a second power termination;

the right rear riser coil section connects the rear right upper longitudinal coil section end by a second right transition coil section to the rear right lower longitudinal coil section end by a third right transition coil section;

the left upper longitudinal coil section has a front left upper longitudinal coil section end and a rear left upper longitudinal coil section end;

the left lower longitudinal coil section has a front left lower longitudinal coil section end and a rear left lower longitudinal coil section end, the front left lower longitudinal coil section end connected to the first power termination;

the left front riser coil section has a first left front riser coil section end and a second left front riser coil section end, the second left front riser coil section end opposing the first left front riser coil section end, the first left front riser coil section end connected to the front left upper longitudinal coil section end by a first left transition coil section and the second left front riser coil section end disposed adjacent to the front left lower longitudinal coil section end and connected to the second power termination; and the left rear riser coil section connects the rear left upper longitudinal coil section end by a second left transition coil section to the rear left lower longitudinal coil section end by a third left transition coil section;

whereby a transverse flux induced instantaneous current flows in opposing directions in the head and the foot when one or more power sources are connected to the first and second power terminations.

5. The transverse flux electric induction rail heater of claim 1 further comprising a transverse coil actuator apparatus for changing a transverse separation distance between the right rail side coil and the left rail side coil.

6. The transverse flux electric induction rail heater of claim 1 further comprising a transverse coil pivoting actuator apparatus for changing a transverse separation distance between the right lower longitudinal coil section and the left lower longitudinal coil section.

7. The transverse flux electric induction rail heater of claim 1 further comprising a vertical coil actuator apparatus for changing a vertical separation distance between the right and left upper longitudinal coil sections and the head, and between the right and left lower longitudinal coil sections and the foot.

8. The transverse flux electric induction rail heater of claim 1 further comprising a vertical rail actuator apparatus for changing a vertical separation distance between the right and left upper longitudinal coil sections and the head, and between the right and left lower longitudinal coil sections and the foot.

9. The transverse flux electric induction rail heater of claim 1 further comprising an upper magnetic "C" core disposed over and around an outer sides of the right and left upper longitudinal coil sections and a lower magnetic "C" core disposed under and around an outer sides of the right and left lower longitudinal coil sections.

10. The transverse flux electric induction rail heater of claim 1 further comprising:

a right rail side magnetic "E" coil disposed over the right upper longitudinal coil section and extending downward around the outer sides of the right upper and lower longitudinal coil sections and under the right lower longitudinal coil section, a center leg of the right rail side magnetic "E" coil extending within a space between the right front riser coil section and the right rear riser coil section; and a left rail side magnetic "E" coil disposed over the left upper longitudinal coil section and extending downward around the outer sides of the left upper and lower longitudinal coil sections and under the left lower longitudinal coil section, a center leg of the left rail side magnetic "E" coil extending within a space between the left front riser coil section and the left rear riser coil section.

11. The transverse flux electric induction rail heater of claim 1 further comprising:

an upper right rail side magnetic "C" core disposed over and around an outer side of the right upper longitudinal coil section, a bottom leg of the upper right rail side magnetic "C" core extending inward facing the right side of the head;

a lower right rail side magnetic "C" core disposed under and around an outer side of the right lower longitudinal coil section, a top leg of the lower right rail side magnetic "C" core extending inward facing the right side of the web;

an upper left rail side magnetic "C" core disposed over and around an outer side of the left upper longitudinal coil section, a bottom leg of the upper left rail side magnetic "C" core extending inward facing the left side of the head; and a lower left rail side magnetic "C" core disposed under and around an outer side of the left lower longitudinal coil section, a top leg of the lower right rail side magnetic "C" core extending inward facing the left side of the web.

12. The transverse flux electric induction rail heater of claim 11 further comprising a magnetic "C" core assembly adjustment apparatus for independently adjusting each of the upper and lower right rail side magnetic "C" cores and the upper and lower left rail side magnetic "C" cores in a transverse and vertical directions.

13. The transverse flux electric induction rail heater of claim 1 wherein the longitudinal section of the rail passing through the transverse flux electric induction rail heater comprises an opposing ends of a first and a second rail.

14. A transverse flux electric induction rail heater for inductively heating a longitudinal section of a rail passing through the transverse flux electric induction rail heater, the rail having a head joined to a foot by a web, the transverse flux electric induction rail heater comprising:

a magnetic "C" core having a "C" core opening;

a solenoidal coil wound around the magnetic "C" core; and an alternating current power source connected to the solenoidal coil;

whereby selectively inserting a section of the rail within the "C" core opening concentrates an induced eddy current heating in the head, web and/or foot of the rail.

15. A method of inductively heating at least one longitudinal section of a rail having a head joined to a foot by a web, the rail having a first side and a second side oriented on opposing cross sectional sides of the rail, the method comprising:

passing the at least one longitudinal section of the rail through a transverse flux electric induction rail heater, the transverse flux electric induction rail heater comprising:

a right rail side coil disposed adjacent to the first side of the rail, the right rail side coil comprising:

a right upper longitudinal coil section disposed parallel to the longitudinal section of the rail and located adjacently above the first side of the head;

a right lower longitudinal coil section disposed parallel to the longitudinal section of the rail and located adjacently below the first side of the foot;

a right front riser coil section disposed adjacently to the first side of the rail and oriented perpendicular to the longitudinal section of the rail, the right front riser coil section connecting a front adjacent ends of the right upper and lower longitudinal coil sections; and a right rear riser coil section disposed adjacently to the first side of the rail and oriented perpendicular to the longitudinal section of the rail, the right rear riser coil section connecting a rear adjacent ends of the right upper and lower longitudinal coil sections;

whereby the right rail side coil forms at least a first one turn coil along the first side of the rail;

and a left rail side coil disposed adjacent to the second side of the rail, the left rail side coil comprising:

a left upper longitudinal coil section disposed parallel to the longitudinal section of the rail and located adjacently to the right upper longitudinal coil section above the second side of the head;

a left lower longitudinal coil section disposed parallel to the longitudinal section of the rail and located adjacently to the right lower longitudinal coil section below the second side of the foot;

a left front riser coil section disposed adjacently to the second side of the rail and oriented perpendicular to the longitudinal section of the rail, the left front riser coil section connecting a front adjacent ends of the left upper and lower longitudinal coil section ends; and a left rear riser coil section disposed adjacently to the second side of the rail and oriented perpendicular to the longitudinal section of the rail, the left rear riser coil section connecting a rear adjacent ends of the left upper and lower longitudinal coil sections;

whereby the left rail side coil forms at least a second one turn coil along the second side of the rail; and supplying an alternating current power source to the right rail side coil and the left rail side coil to inductively heat the at least one longitudinal section of the rail.

16. The method of claim 15 wherein the at least one longitudinal section of the rail comprises an opposing ends of a first rail and a second rail.

17. The method of claim 1 wherein the right rail side coil and the left rail side coil each comprise a multi-turn coil.

* * * * *